United States Patent [19]

Mochizuki et al.

[11] Patent Number: 4,801,965

[45] Date of Patent: Jan. 31, 1989

[54] COLOR RECORDING APPARATUS

[75] Inventors: Manabu Mochizuki, Yokohama; Tsuneo Kurotori, Tokyo; Toshiharu Hasegawa, Shiroishi, all of Japan

[73] Assignee: Ricoh Company Ltd., Tokyo, Japan

[21] Appl. No.: 28,084

[22] Filed: Mar. 19, 1987

[30] Foreign Application Priority Data

Mar. 24, 1986 [JP] Japan ..... 61-65442

[51] Int. Cl.[4] ..... G03G 15/06

[52] U.S. Cl. ..... 355/4; 118/645; 118/652; 355/14 D; 355/15

[58] Field of Search ..... 355/3 DD, 4, 14 D, 15, 355/10; 118/645, 652, 659, 660, 647; 354/324

[56] References Cited

U.S. PATENT DOCUMENTS

| | | | |
|---|---|---|---|
| Re. 28,568 | 10/1975 | Saito et al. | 355/10 X |
| 4,190,346 | 2/1980 | Hutson et al. | 354/324 |
| 4,627,705 | 12/1986 | Landa et al. | 355/4 |
| 4,640,605 | 2/1987 | Ariyama et al. | 355/4 |
| 4,650,308 | 3/1987 | Burbury | 354/324 X |

*Primary Examiner*—Arthur T. Grimley
*Assistant Examiner*—Jane Lau
*Attorney, Agent, or Firm*—Mason, Fenwick & Lawrence

[57] ABSTRACT

An electrophotographic recording apparatus having a photoconductive element, means for providing an electrostatic latent image on the photoconductive element which corresponds to image light, a developing device for developing the latent image to produce a visible image, means for transferring the visible image onto a paper, and means for cleaning the surface of the photoconductive element after the transfer of the visible image. Developers of different colors are selectively supplied to the single developing device to selectively record images in different colors. When a predetermined period of time has expired with no recording action taken after the completion of color recording, a developer collection system is communicated to a cleaning liquid vessel. This shortens the period of time necessary for the next change of recording color and recording operation while allowing a minimum of damage to result from a trouble in the developer collection system.

3 Claims, 14 Drawing Sheets

POWER ON
INITIALIZE
1
START CONTROLLING FIXING HEATER
2
※START COUNTING TIME
※SET BLACK FLAG
6
SENSE STATES
3
FAILURE ?
4
YES
NO
FAILURE PROCESSING
5
FAILURE RESET
6
ENERGIZE MAIN MOTOR & PUMP 38
7a
※ROTATE RDUM 3 THREE TIMES
ENERGIZE MAIN CHARGER
SWITCH 43 CLOSED ?
8
YES
NO
TIME T ≧ T1 OR HEATER TEMP ≧ FIXING TEMP ?
7b
YES
NO
ENERGIZE SOLENOID FOR t1
9
※DEVELOPER COLLECTION IN 30

| |
|---|
| Fig. 4c-1 |
| Fig. 4c-2 |

COLOR RECORDING APPARATUS

BACKGROUND OF THE INVENTION

The present invention relates to a recording apparatus for selectively recording images in black and colors other than black. More particularly, the present invention relates to, but not limited to, an electrophotographic recording apparatus of the type having a photoconductive element, means for providing an electrostatic latent image corresponding to image light on the photoconductive element, a device for developing the latent image to produce a visible image, means for transferring the visible image onto a paper, and means for cleaning the photoconductive element after the image transfer, whereby images are selectively recorded in a plurality of different colors.

Prior art color copiers which belong to a family of recording apparatuses include a one in which liquid developers of different colors are supplied to a single developing unit, as disclosed in Japanese Patent Publication No. 54-43898 by way of example. Another type of prior art color copier, i.e., monocolor type color copier is furnished with the same number of powder type developing units which may be selectively mounted in a body of the copier.

A problem with the single developing unit type scheme is that because liquid developers of different colors are fed to the single developing unit, colors used one after another for recording are mixed together resulting in an impure recording. Another problem is that several copies have to be wasted before a desired pure color is obtained. Further, any developer collected from the developing unit into a developer vessel is tainted by a color previously used, contaminating the whole developer stored in the vessel. This make it necessary for the developing unit to be cleaned every time the recording color is changed. On the other hand, the multiple developing unit type scheme suffers from a drawback that replacing the developing unit mounted in a copier body is troublesome and, in addition, the substantial number of mechanical elements, particularly those which are independent of a copier body, are awkward to handle.

In the light of the above, a handy color recording apparatus of the first-mentioned type is constructed such that in the event of a change of color the developing unit is cleaned and, then, supplied with a developer of another color.

To clean the developing unit, a vessel which stores a cleaning agent is provided so that the cleaning agent may be circulated to serve the cleaning function. In operation, it is not usual that the recording color is changed frequently and, rather, it often occurs that only a color change command is entered on an operating board. Generally, therefore, it is only after a change of recording color has been commanded and, then, a recording operation in the desired color has been commanded that an actual color changing process and the subsequent recording process are performed. Specifically, so long as the operation does not proceed farther than the entry of a color change command, the recording apparatus is held in a standby mode with one of its developer supply systems associated with the previous color selected. That is, in such a recording apparatus, after a particular recording color has been entered and data has been recorded in that color, the developer supply system adapted for the developer of the color used is maintained in an operable state. Such stems from the fact that the probability for data to be recorded consecutively in the same color is great, and the fact that the recording color is not changed frequently, i.e., the operation often does not go beyond the entry of a color change command.

As stated above, the recording apparatus is held inoperative with its developer supply system and developer collection system changed over to those which are associated with a color used immediately before. Hence, before starting a recording operation with a developer of new color, the developing unit is cleaned by replacing the developer supply and collection systems with, respectively, a cleaning agent supply and a collection system and, the, replacing the latter with a developer supply and a collection system adapted for the new color. This is followed by an actual recording process. Such a procedure results in a disproportionately long color changeover time.

Further, should the developer supply and collections systems associated with a color used immediately before be continuously held ready for operation, a long time of suspension of operation of the recording apparatus would cause a trouble to occur in the mechanism of a part of the developer supply and collection systems. If the change of color is incomplete due to such a trouble, the previous color is apt to be mixed with a new color. It is therefore preferable that when a long time of suspension of operation is presupposed. the developer supply and collection systems be replaced with the cleaning agent supply and collection systems.

SUMMARY OF THE INVENTION

It is therefore an object of the present invention to, in a color recording apparatus capable of selectively supplying developers of different colors to a developing unit to change a recording color, shorten a color changeover and recording time while allowing a minimum of trouble to occur in a developer collection system due to a change of color.

It is another object of the present invention to provide a generally improved color recording apparatus.

A recording apparatus having a visualizing device which selectively supplies visualizing agents to a photoconductive element of the present invention comprises a first vessel storing a black visualizing agent, a second vessel storing a visualizing agent of another color, a cleaner vessel storing a cleaning agent for cleaning the visualizing agents, first supply means for supplying the visualizing agent in the first vessel to the visualizing device, second supply means for supplying the visualizing agent in the second vessel to the visualizing device, cleaner supply means for supplying the cleaning agent in the cleaner vessel to the visualizing device, switching means for causing the agents to be selectively collected from the visualizing device in the first, second and cleaner vessels, color commanding means for commanding a recording color, monitoring means for monitoring a condition of supply of any of the agents to the visualizing device, recording means for comparing a recording color commanded by the color commanding means and an agent supply condition outputted by the monitoring means and, when the agent supply condition and the commanded color are not identical, cleaning the visualizing device by commanding the cleaner supply means supply of the cleaning agent and commanding the switching means collection in the cleaner vessel and, after the cleaning, actuating the supply means and switching means in correspondence to the commanded color to supply any of the agents of the commanded color to the visualizing device, thereby performing recording in the commanded color, and control means for conditioning the switching means for collection in the cleaner vessel when a predetermined period of time expires before the recording means begins a recording operation after a recording operation in another color.

The above and other objects, features and advantages of the present invention will become more apparent from the following detailed description taken with the accompanying drawings.

DESCRIPTION OF THE PREFERRED EMBODIMENTS

Figure 1:
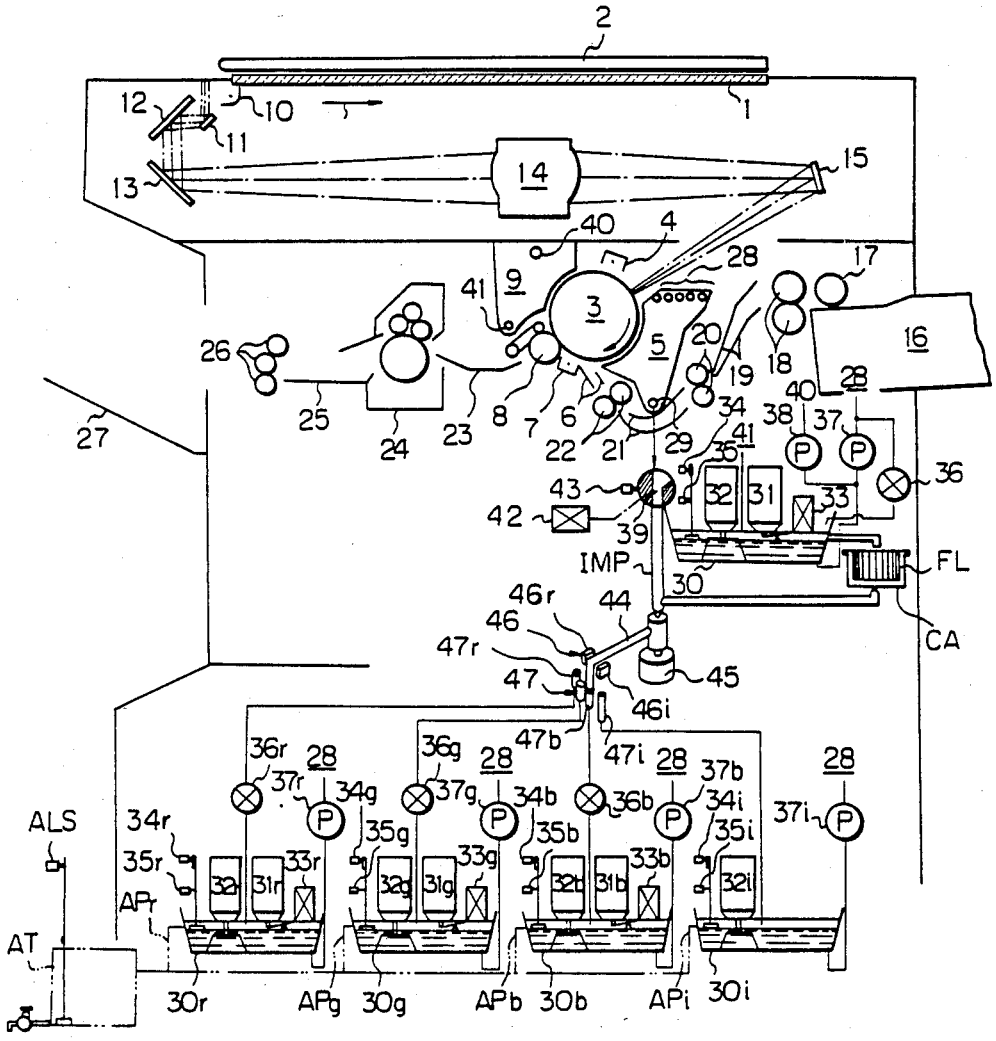
FIG. 1 is a block diagram showing a color recording apparatus embodying the present invention, mainly its mechanical arrangement.

Referring to FIG. 1 of the drawings, a color recording apparatus embodying the present invention is shown. In this particular embodiment, the apparatus is assumed to be a monocolor copier. A document, not shown, is laid on a glass platen 1 and pressed down by a cover plate 2. While a lamp 10 illuminates the document on the glass platen 1, light reflected from the document is focused on the surface of a photoconductive drum 3 via a first mirror 11, a second mirror 12, a third mirror 13, a lens unit 14, and a fourth mirror 15. The drum 3 is rotated clockwise as viewed in FIG. 1 by a main motor, not shown, through a gearing, not shown. The lamp 10 and first mirror 11 are mounted on a first carriage, not shown, which is driven in a direction indicated by the arrow in FIG. 1 at a predetermined velocity. Likewise, the second and third mirrors are mounted on a second carriage, not shown, which is driven in the direction A at one half the velocity of the first carriage. A main charger 4 deposites a uniform electrostatic charge on the surface of the drum 3. The charged surface of the drum 3 is exposed imagewise by the light from the document, whereby an electrostatic latent image is produced on the drum surface. The latent image is developed by a developing unit 5 to become a visible image. At a station where a transfer charger 7 is located, the visible image is transferred to a paper which is fed from a cassette 16 by feed rollers 17 and, then, routed along paper guides 19, 21 and 6 by transport rollers 18 and 20 and register rollers 22. The paper carrying the visible image thereon is separated from the drum 3 by a separating unit 8 and, then, guided by a paper guide 23 toward a fixing unit 24. The fixing unit 24 applies heat to the paper to fix the image carried thereon. Subsequently, the paper is fed out to a tray 27 by discharge rollers 26, while the surface of the drum 3 is cleaned by a cleaning unit 9.

Before the start of a copying operation, during copying cycles and an end cycle, and other various conditions, the various structural elements as stated above are controlled in a manner well known in relation to monochromatic (black) copiers as well as certain kinds of full-color copiers.

Figure 2A:
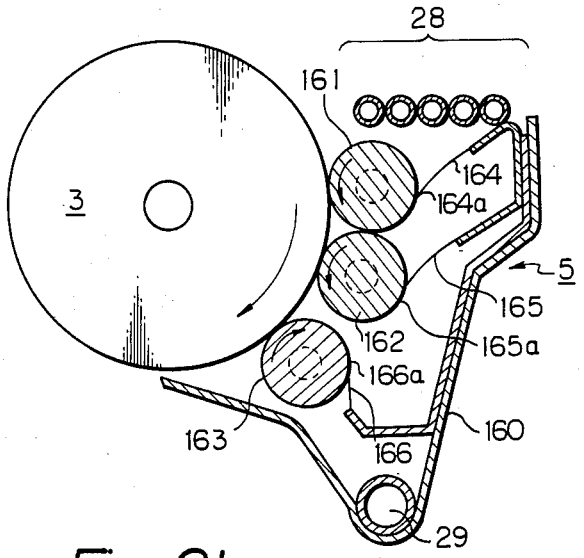
FIG. 2*a* is a section showing the interior of a developing unit which is included in the apparatus of FIG. 1.

Referring to FIG. 2*a*, the interior of the developing unit 5 is shown in detail. As shown, the developing unit 5 is provided with liquid developer and liquid cleaner inlets, generally 28, and a liquid developer and liquid cleaner outlet 29. A first developing roller 161, a second developing roller 162 and a squeeze roller 163 are individually journalled to a receptacle of the unit 5. These rollers 161 to 163 are made of a conductive material and are slightly spaced from the surface of the drum 3. Individually connected to the main motor through a gearing, the rollers 161 and 162 are rotatable counterclockwise and the motor 163, clockwise. The rollers 161 to 163 are rotated while the drum 3 is in rotation, and stopped while the latter is stopped. Scrapers 164, 165 and 166 are respectively held in contact with the rollers 161, 162 and 163 at free ends thereof. Each of the scrapers 164 to 166 serves to scrape the developer off the surface of its associated drum 161, 162 or 163. The scrapers 164 and 165 also serve the function of accumulating the developer or the cleaner thereon which flows down from the above. The liquid accumulated on the scrapers 164 and 165 wets the surfaces of the rollers 161 and 162 while being transferred from the rollers to the drum 3 due to the attraction exerted by the charge on the drum 3. The roller 163 is adapted to remove an excessive amount of liquid from the surface of the drum 3.

When it is desired to change the recording color, the liquid cleaner is fed to the developing unit 5 in order to clean its interior. During this cleaning period, an electric field is applied to the cleaner, which fills the unit 5, by charging the drum 3 and by applying a developing bias voltage to the developing rollers. This is achievable by, during the cleaning period, charging the drum 3 to the opposite polarity to a toner, setting up a non-exposure condition such as by turning off the lamp 10, and performing a developing process with a developing bias voltage applied to the developing rollers.

Figure 2B:
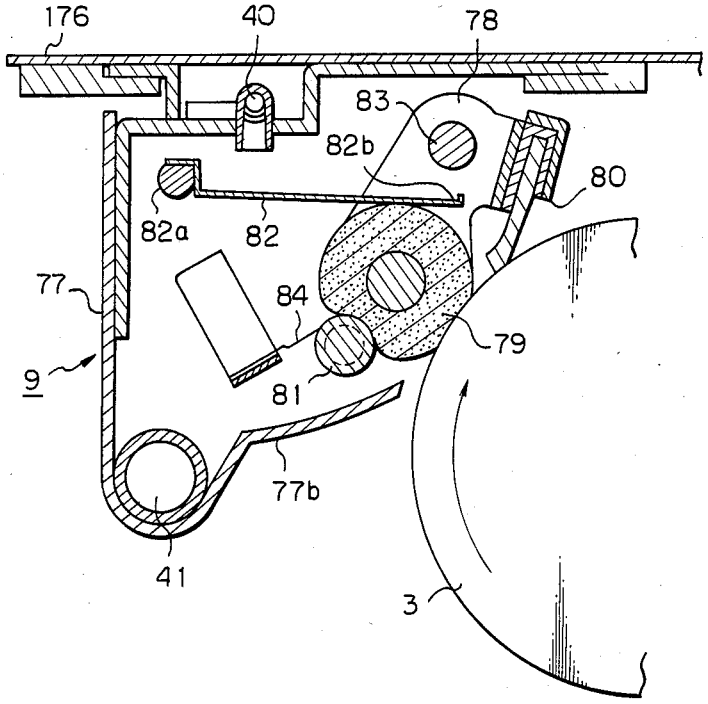
FIG. 2*b* is a section showing the interior of a cleaning unit as also included in the apparatus of FIG. 1.

Referring to FIG. 2*b*, the internal construction of the cleaning unit 9 is shown. As shown, the cleaning unit 9 includes a receptacle 77 which is secured to a support arm 176 which is in turn integral with a frame, not shown, of a copier housing. A bracket 78 is rotatably mounted on a shaft 83 which is fixed to the frame of the copier body. A blade 80 is secured to one end of the bracket 78 while a sponge roller 79 is rotatably mounted on the other end of the bracket 78. A squeeze roller 81 is journalled to the frame of the copier body. A scraper 84 is held in contact with the squeeze roller 81 so as to remove liquid which is scraped by the squeeze roller 81 off the sponge roller 79. A tray 82 is rigidly mounted on a shaft 82*a* which is rotatably mounted to the frame of the copier body. The tray 82 rests on the roller 79 by gravity. The receptacle 77 is provided with an inlet 40 at its upper end and an outlet 41 at its lower end. Fed to the inlet 40 is a liquid developer which is pumped from a black developer vessel (first vessel) 30 by a pump 38. The developer coming in through the inlet 40 flows down onto the tray 82 and advances therealong until it falls fall onto the drum 3 from the free end 82*b* of the tray 82. As a result, the developer is accumulated between the drum 3 and the roller 79 to clean the drum surface. A solenoid, not shown, has a plunger which is connected to the bracket 78 by an arm, not shown. While the drum 3 is in rotation, the solenoid is continuously energized to press the blade 80 and roller 79 against the drum 3, as shown in FIG. 2*b*. However, when the drum 3 is brought to a halt, the solenoid is deenergized to rotate the bracket 78 clockwise about the shaft 83 under the action of a return spring, not shown, resulting that the blade 80 and roller 79 are moved away from the drum 3 with the roller 79 freed from the compressive force of the roller 81.

Referring again to FIG. 1, fluidly communicated to the inlets 28 of the developing unit 5 are the delivery port of a first pump 37, that of a second pump 37*r*, that of a third pump 37*g*, that of a fourth pump 37*b*, and that of a cleaner pump 37*i*, respectively. The outlet 29 of the unit 5 is communicated to the inlet port of a directional control valve 39. The outlet port of the valve 39 is selectively connectable to the first vessel (black developer vessel) 30 and a common passage IMP which leads to a nozzle 44. The valve 39 is operated by a two-position selector mechanism, not shown, which is in turn driven by a solenoid 42. When the solenoid 42 is energized once while the valve 39 is so positioned as to provide communication between the outlet 29 and the common path IMP (nozzle 44), as shown in FIG. 1, the selector mechanism drives the valve 39 counterclockwise to communicate the outlet 29 to the first vessel 30. Conversely, when the solenoid 42 is energized once while the outlet 29 is in communication with the first vessel 30 as stated, the selector mechanism drives the valve 39 clockwise to provide communication between the outlet 29 and the common path IMP (nozzle 44). In this manner, the valve 39 is switched from one to the other of the two positions every time the solenoid 42 is energized. A switch 43 is associated with the valve 39 and constructed such that it is closed when the outlet 29 is communicated to the common path IMP and opened when it is communicated to the first vessel 30.

The nozzle 44 is rotatably supported by a stepping motor 45 so as to serve as another selector means. Specifically, collecting pipes 47 (47*r*, 47*g* and 47*b*) are arranged below the outlet of the nozzle 44 through liquid guides, not shown. When the outlet of the nozzle 44 is located above the pipe 47*r*, the liquid coming out from the nozzle 44 is routed to a second vessel (red developer vessel) 30*r*; when it is located above the pipe 47*g*, the liquid is routed to a third vessel (green developer vessel) 30*g*; when it is located above the pipe 47*b*, the liquid is routed to a fourth vessel (blue developer vessel) 30*b*; and when it is located above the pipe 47*i*, the liquid is routed to a cleaner vessel 30*i*. Switches 46 (46*r*, 46*g*, 46*b* and 46*i*) are provided for sensing the four different positions of the nozzle 44, respectively. Specifically, the switch 46*r* is closed when the outlet of the nozzle 44 is aligned with the pipe 47*r*; the switch 46*g* is closed when it is aligned with the pipe 47*g*; the switch 46*b* is closed when when it is aligned with the pipe 47*b*; and the switch 46*i* is closed when it is aligned with the pipe 47*i*.

The pump 38 feeds the black developer from the first vessel 30 to the inlet of the cleaning unit 9. The black developer flowing down through the outlet of the unit 9 is returned to the vessel 30 via a conduit, not shown.

Mounted in the first vessel 30, second vessel 30*r*, third vessel 30*g* and fourth vessel 30*g* are, respectively, a black developer container, 31, a red developer container 31*r*, a green developer container 31*g* and a blue developer container 31*b* and diluent containers 32, 32*r*, 32*g* and 32*b*. Solenoids 33*r*, 33*g*, 33*b* and 33*i* are respectively connected to the developer containers 31, 31*r*, 31*g* and 31*b* by individual links. When any of the solenoids 33*r* to 33*i* is energized, the mouth of its associated developer container is opened to let the developer fall. The nozzle tip of a mouthpiece of each of the diluent containers 32, 32*r*, 32*g* and 32*b* is abutted against a support plate which is disposed in the vessel 30, 30*r*, 30*g* or 30*b* and, thereby, raised relative to the container to keep the mouth of the container open into the vessel. Hence, as the liquid level in any of the vessels is lowered, the diluent is introduced into the vessel from its associated diluent container. Disposed in the cleaner vessel 30i is a cleaner container 32*i* only. The nozzle tip of a mouthpiece of the container 32i is raised relative to the container in abutment against a support plate, which is provided in the vessel 30*i*, whereby the mouth of the container is open into the vessel. As the liquid level in the vessel 30*i* is lowered, the liquid cleaner inside of the container is allowed to flow thereoutof into the vessel 30*i*.

The first vessel 30 is provided with a float responsive to the liquid level in the vessel, an upper limit switch 34 responsive to an upper limit position of the float, and a lower limit switch 35 responsive to a lower limit position of the float. Likewise, the vessels 30*r* to 30*b* and 30*i* are respectively provided with floats, upper limit switches 34*r* to 34*b* and 34*i*, and lower limit switches 35*r* to 35*b* and 35*i*.

The first vessel 30 is provided with an overflow port at a level thereof which is slightly higher than a level where the upper limit switch 34 becomes closed (detection of upper limit). Fluidly connected to the overflow port is the inlet of a purifying device CA. The outlet of the purifying device CA is communicated to the common path IMP.

Figure 2C:
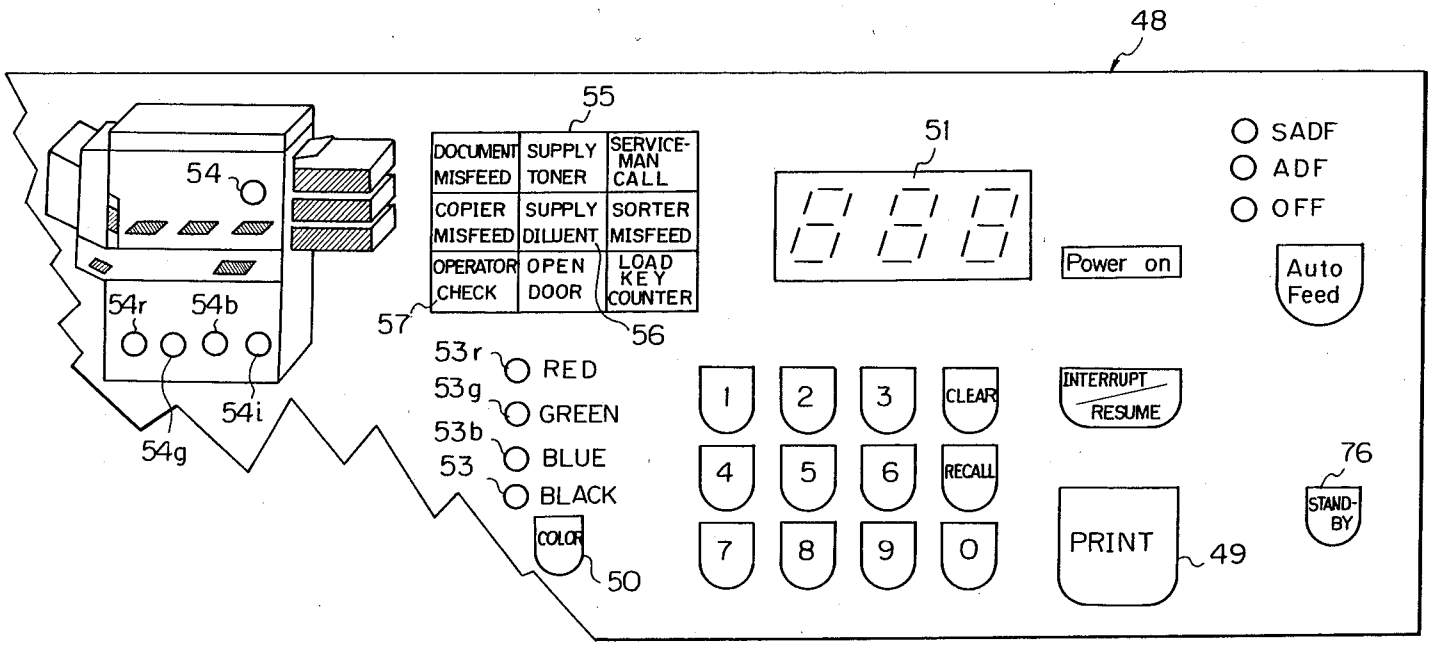
FIG. 2*c* is a fragmentary plan view of an operating board in accordance with the same embodiment.
Figure 2D:
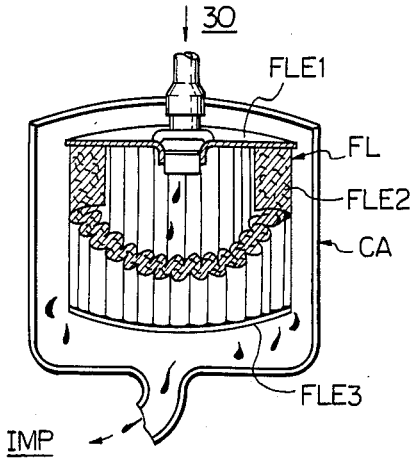
FIG. 2*d* is a section showing the interior of a purifying device of FIG. 1.

As shown in FIG. 2*d*, the purifying device CA comprises a cup-shaped housing (CA) and a hollow filter tube FL which is received in the housing. The filter tube FL is made up of an upper disk FLE1, a cylindrical body FLE2, and a lower disk FLE3 which are secured together in a liquid-tight configuration. The upper disk FLE1 is provided with a mouthpiece to which a conduit leading to the overflow port of the first vessel is rigidly connected. The cylindrical body FLE2 is configured zigzag in order to increase its area available for filtering. All the members FLE1, FLE2 and FLE3 are made of a filtering material which allows the passage of solvent (diluent) while preventing the passage of toner which is contained in a developer. In this construction, as the developer from the first vessel 30 is admitted into the purifying device CA, it enters the filtering tube FL so that the toner of the developer is captured by the tube FL, but the solvent (diluent) is passed through the tube FL. Then, the solvent is routed to the common path IMP via the internal space of the housing (CA) and, therefrom, to the second, third, fourth or cleaning vessel 30*r*, 30*g*, 30*b* or 30*i* by way of the nozzle 44. When the filter tube FL is clogged to make it difficult for the solvent (diluent) to pass therethrough, the tube FL becomes filled with the developer and, subsequently, the liquid level in the first vessel 30 is raised until the upper limit switch 34 has been closed (detection of upper limit). Closing of the switch 34, therefore, is representative of clogging of the tube FL and the increase in the liquid level in the vessel 30 beyond an allowable limit. Generally, the probability for the developer to flow from the vessel 30 to the purifying device CA is relatively high only when a substantial amount of developers is collected from the cleaning unit 9 to the vessel 30 due to the frequent recording or the recording of solid images in red, green and/or blue, and when a substantial amount of developer is fed from the developer container 31 to the vessel 30 due to the frequent recording of solid images in black. Because such occurrences are quite rate, the probability for the developers to flow into the filter tube FL is very small. Hence, a copying cycle may be repeated over a long period of time until the filter tube FL becomes clogged. To further extend the service life of the filter tube FL, the tube FL may be filled with a substance which is highly absorptive for toner, e.g. activated charcoal, ion exchange resin and others which may take the form of granule, powder or filament. Such would effectively reduce the rate of deposition of toner on the inner wall of the tube FL.

Figure 3:
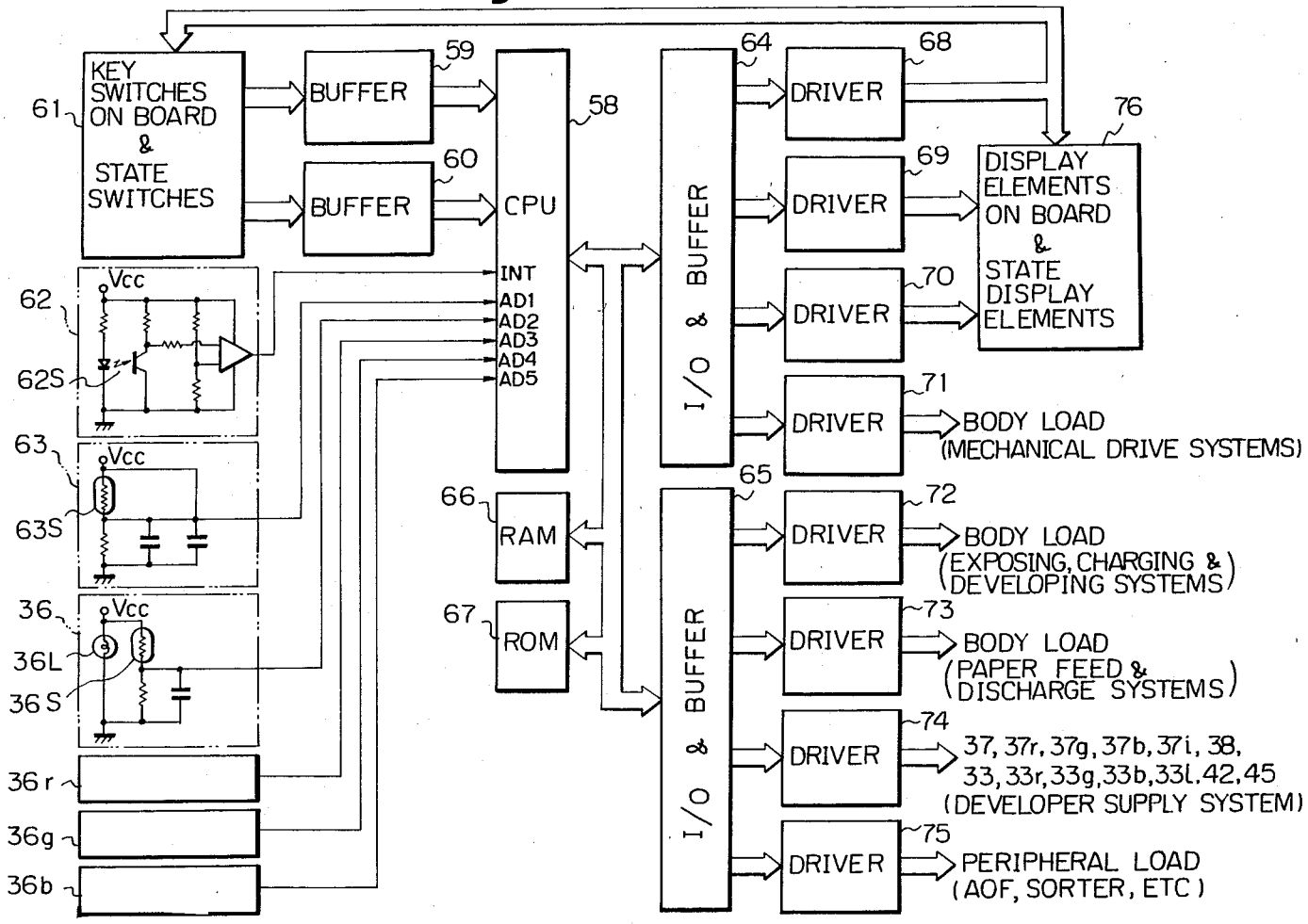
FIG. 3 is a block diagram showing an electrical control system of the same embodiment.

A part of the liquid which is delivered from the first pump 37 is returned to the first vessel 30 via a first density detecting unit 36, which is responsive to the density of the black developer. A second density detecting unit **36*r* is associated with the pipe 47*r* adapted to return the developer to the second or red developer vessel 30*r*; a third density detecting unit 36*g* is associated with the pipe 47*g* adapted to return the developer to the third or gree developer vessel; and a fourth density detecting unit 36*b* is associated with the pipe 47*b* adapted to return the developer to the fourth or blue developer vessel 30*b*. Each of the density detecting units stated above mainly consists of passage means for causing a developer to flow down in a film configuration, a lamp (36L in FIG. 3) and a photoelectric transducer (36S in FIG. 3) which face each other with the intermediary of the film-like developer. An electric circuit associated with the detecting units 36, 36*r*, 36*g* and 36*b* is shown in FIG. 3. It is to be noted that the detecting units 36, 36r, 36g and 36**b are identical in electrical construction.

While the drum 3 is rotated, the rollers 161, 162 and 163 of the developing unit 5 are also rotated and the bracket 8 of the cleaning unit 9 is held in the position of FIG. **2*b*. In this condition, the blade 80 and sponge roller are maintained in pressing contact with the drum 3. Further, the pump 38 is energized to feed the black developer to the cleaning unit 9**.

In a red record mode, the valve 39 is so positioned as to provide communication between the outlet 29 and the nozzle 44, the nozzle 44 is aligned with the pipe **47*r*, and the pump 37*r* is energized to supply the developing unit 5** with the red developer.

In a green record mode, the valve 39 is positioned to provide communication between the outlet 29 and the nozzle 44, the nozzle 44 is brought into alignment with the pipe **47*g*, and the pump 37*g* is energized to feed the green developer to the developing unit 5**.

In a blue record mode, the nozzle 44 is positioned above the pipe **47*b* with the outlet 29 communicated to the nozzle 4 by the valve 39. The pump 37*b* is energized to feed the blue developer to the developing unit 5**.

When the black record mode is replaced with the red record mode, the first pump 37 is deenergized and, upon the lapse of a predetermined draining time $T_1$ for draining the developer, the valve 39 is switched to the nozzle 44 side and the nozzle 44 is brought into alignment with the pipe **46*i*. Then, the pump 37*i*** is energized for a cleaning time $t_2$.

During the cleaning time $t_2$, an electric field is applied to the developing unit 5. Specifically, processing similar to a usual developing process is executed except that the lamp 10 and the scanning mechanism are not activated. At this instant, the drum 3 is charged by a main charged 4 to the opposite polarity to the toner while, at the same time, a developing bias voltage of the same polarity as the toner is applied to the developers 161 and 162 of the unit 5. Consequently, the toner inside the unit 5 is electrodeposited on the drum 3 and, then, removed through the cleaning unit 9.

As the instant when the cleaning time $t_2$ has expired, the pump **37*i* is deenergized. Upon the lapse of another draining time $T_1$ after the deactivation of the pump 37*i*, the nozzle 44 is positioned above the pipe 47*r* and the pump 37*r*** is energized.

A changeover from the black record mode to a green or a blue record mode is effected in the same manner as stated above. While a changeover from one to another of the red, green and blue record modes is also effected in the abovedescribed manner, the position of the valve 39 is not changed in such a case.

In the event when any of the red, green and blue record modes is replaced with the black record mode, the recording color is necessarily black even if the red, green or blue developer is mixed with the black developer. Hence, in order to shorten the switching time to the black record mode of frequent use, the pump **37*r*, 37*g* or 37*b* is deenergized, the valve 39 is switched to the first vessel 30 side, and the first pump 37 is energized. In this case, the cleaning agent, or cleaner, is not supplied to the developing unit 5. This saves the developer draining time $T_1$, the cleaning time $t_2$, and the cleaner draining time $T_1$. It should be noted, however, that a copying operation is restrained until a period of time $t_5$, which is necessary for the black developer to be sufficiently distributed to all the rollers 161, 162 and 163, expires after the energization of the first pump 37**.

Referring to FIG. **2*c*, a part of an operating board 48 which is provided on the copier of FIG. 1 is shown. The elements shown in FIG. 2*c*** and their operations are as follows.

Standby command switch 76: After a power switch, not shown, has been turned on and while a light emitting element built in the switch 76 is extinguished, turning on a switch 76 causes the light emitting element to glow, brings the copier into a standby condition, and energizes the fixing heater to generate heat of low temperature. As the switch 76 is turned on while the light emitting element is glowing, the element is extinguished, the copier is brought into a copy command waiting state, and the fixing heater is caused to generate heat of high temperature.

Copy start switch 49: In the copy command waiting state, a green light emitting element built in a switch 49 glows if the copier is ready to start copying. When the switch 49 is turned on under the above condition, a copying cycle is commenced. Upon the start of a copying cycle, a red light emitting element also built in the switch 49 glows in place of the green one and continuously glows until a desired number of copies have been produced. As soon as the desired number of copies are produced, the red light emitting element is extinguished and, instead, the green one is caused to glow. Further, when the copier is disabled for one reason or another either during or after the copying operation, the green light emitting element is turned off and the red one is turned on.

Light emitting element SADF: An element SADF glows when a semi-automatic document feeder (SADF) is mounted on the copier.

Light emitting element ADF: An element ADF glows when an automatic document feeder (ADF) is mounted on the copier.

Light emitting element OFF: An element OFF glows when the copier is not loaded with any document feeder.

Automatic feed command switch Auto Feed: When a switch Auto Feed is depressed, a light emitting element built therein glows and, at the same time, the copier is caused into an automatic feed mode for automatically feeding documents one by one from a feeder mounted on the copier to the glass platen 1. When the switch Auto Feed is depressed while its light emitting element is glowing, the latter is extinguished and the copier is restored to an ordinary mode in which a document may be laid by hand on the glass platen 1.

Power lamp Power On: A lamp Power On glows when the power switch is ON and extinguishes when the latter is OFF.

Interrupt command switch Interrupt/Resume: When a switch Interrupt/Resume is turned on while a light emitting element built therein is extinguished, various state data associated with the operating board 48 and copy data associated with the copier (number of copies produced and others) are written into a memory, the copier being restored to the copy command waiting state with the copy number reset to "1". In this condition, one may command a copying operation after changing the settings on the board 48 as desired (interrupt copy setting state). As the switch Interrupt-/Resume is turned on while the light emitting element is extinguished, data previously stored in the memory are read out so that the board 48 is conditioned according to those data and, at the same time, the number of copies produced and other data are loaded again.

Three-figure character display 51: A display 51 displays a set number of copies before the start of a copying operation, and a produced number of copies after the start of a copying operation. The display 51 is also used to alert an operator to troubles.

Ten key switches 0 to 9: Switches 0 to 9 are adapted to enter a number of copies and other information.

Switch Clear: A switch Clear is to be manipulated to cancel data which are entered on the ten keys 0 to 9 as well as a set number of copies.

Switch Recall: A switch Recall is adapted to read data which are previously stored and representative of settings of the operating board.

Light emitting element 55: A light emitting element 55 serves to alert an operator to a sort supply of developer. The element 55 glows when the lower limit switch 35, **35*r*, 35*g* or 35*b*** is closed.

Light emitting element 56: A light emitting element 56 indicates a short supply of cleaner. The element 56 glows when the lower limit switch **35*i*** is closed.

Light emitting element 57: A light emitting element 57 is adapted to urge an operator to check the copier. The element 57 glows when any one of the upper limit and lower limit switches is closed and when a failure such as a paper trouble or a mechanism trouble has occurred.

Color indicator lamps 53, **53*r*, 53*g* and 53*b*: When the power switch is turned on, a lamp 53** glows to set up a black record mode.

Color command switch 50: When a switch 50 is turned on while the lamp 53 is glowing, the lamp 53 is extinguished and, instead, the lamp **53*b* is turned on to set up the blue record mode. When the switch 50 is turned on while the lamp 53*b* is glowing, the lamp 53*b* is extinguished and, instead, the lamp 53*g* is turned on to set up the green record mode. When the switch 50 is turned on while the lamp 53*g* is glowing, the lamp 53*g* is extinguished and, instead, the lamp 53*r* is turned to to set upt he red record mode. Further, when the switch 50 is turned on while the lamp 53*r* is glowing, the lamp 53*r* is extinguished and, instead, the lamp 53** is turned on to set up the black record mode.

First vessel trouble indicator lamp 54: A lamp 54 glows when either the upper limit switch 34 or the lower limit switch 35 is closed or when the container 31 is empty.

Second vessel trouble indicator lamp **54*r*: A lamp 54*r* glows when either the upper limit switch 34*r* or the lower limit switch 35*r* is closed or when the container 31*r*** is empty.

Third vessel trouble indicator lamp **54*g*: A lamp 54*g* glows when either the upper limit switch 34*g* or the lower limit switch 35*g* is closed or when the container 31*g*** is empty.

Fourth vessel trouble indicator lamp **54*b*: A lamp 54*b* glows when either the upper limit switch 34*b* or the lower limit switch 35*b* is closed or when the container 32*b*** is empty.

Cleaner vessel trouble lamp **54*i*: A lamp 54*i* glows when eithe rthe upper limit switch 34*i* or the lower limit switch 35*i* is closed or when the container 31*i*** is empty.

The hatched areas around the lamp 54 are representative of those areas which are to be illuminated by paper trouble indicator lamps. The operating board 48 is loaded with other switches and indicator elements as well.

Referring to FIG. 3, an electrical system for actuating the mechanical elements of the copier of FIG. 1 is shown. Various switches 61 such as inputting switches, state sensing switches and state setting switches are connected to a microprocessor (CPU) 58 via buffer amplifiers 59 and 60 and to a driver 68. A drum sync pulse generator 62 is connected to an interrupt input port INT of the CPU 58. The pulse generator 62 is provided with a photosensor 62S adapted to sense slits which are formed through a rotary disk, which is coupled with the drum 3; every time the drum 3 is rotated by a small angle, the sensor 62S senses a slit to apply one pulse to the interrupt input port INT. Connected to an A/D convert input port AD1 is a temperature sensing circuit 63 which is responsive to the temperature of a fixing portion of the fixing unit 24. Specifically, the circuit 63 includes a thermistor 63S adapted to generate a voltage corresponding to the temperature of the fixing portion, the voltage being applied to the port AD1. The developer density sensing units 36, **36*r*, 36*g* and 36*b* are respectively connected to A/D convert input ports AD2, AD3, AD4 and AD5 of the CPU 58. A photoelectric transducer element 36S generates a voltage corresponding to the density of black developer which is pumped by the first pump 37**, the voltage being applied to the port AD2. A lamp 36L emits light toward the element 36S through the film of developer. Constructed in the same manner as the unit 36, the units 36*r*, 36*g* and 36*b* apply voltages corresponding to the densities of red, green and blue developers to the ports AD3, AD4 and AD5, respectively. A read only memory (ROM) 67, a random access memory (RAM) 66 and input/output (I/O) and buffer elements 64 and 65 are connected to the CPU 58 by an address bus, a control bus, and a data bus. The driver 68 and drivers 71 are connected to the I/O port and buffer element 64, and drivers 72 to 75 are connected to the I/O port and buffer element 64.

The driver 68 sequentially applies a switch state read signal to each of Y scanning lines of the switch matrix 61, and a display element energize signal to each of Y scanning line sof a display element matrix 76.

Signals individually associated with X lines of the switch matrix 61, i.e., signals representative of open/-close states of the respective switches are fed to the CPU 58 via the buffers 59 and 60. The CPU 58 delivers the display element energize signal to each of X lines of the display element matrix 76 via the drivers 69 and 70 whenever necessary. In the matrix 76, those elements to which the Y-line and the X-line display energize signals are applied simultaneously are turned on. Connected to the driver 71 are mechanical drive elements (main motor, clutch, etc.), not shown; connected to the driver 72 are electrical imaging elements (lamp 10, chargers 4 and 7, etc.); and connected to the driver 73 are electrical transporting elements (clutch, motor, etc.), not shown. The electrical developer supplying elements, i.e., pumps 38, 37, 37*r*, 37*g*, 37*b* and 37*i*, solenoids 42, 33, 33*r*, 33*g* and 33*b* and stepping motor 45 are connected to the driver 74. Further, connectors adapted to connect electrical elements of a sorter, feeder and other instruments which may be loaded on the copier are connected.

The CPU 58 delivers various kinds of energize signals to the drivers 68 to 75 in response to the manipulation of the various switchs as well as to the statuses of the various parts of the copier. While the operation of the CPU 58 will be desribed hereinafter, the description will concentrate on those parts of the operation which are closely related to the present invention because various kinds of CPU control operations are known in the art in relation to a copier.

FIGS. 4*a*, 4*b*, 4*c*, 4*d*, 4*e*, 4*f* and 4*h* show control routines as performed by the CPU 58 and mainly related to the supply of developers.

Figures 1, 2, 3, 4A:
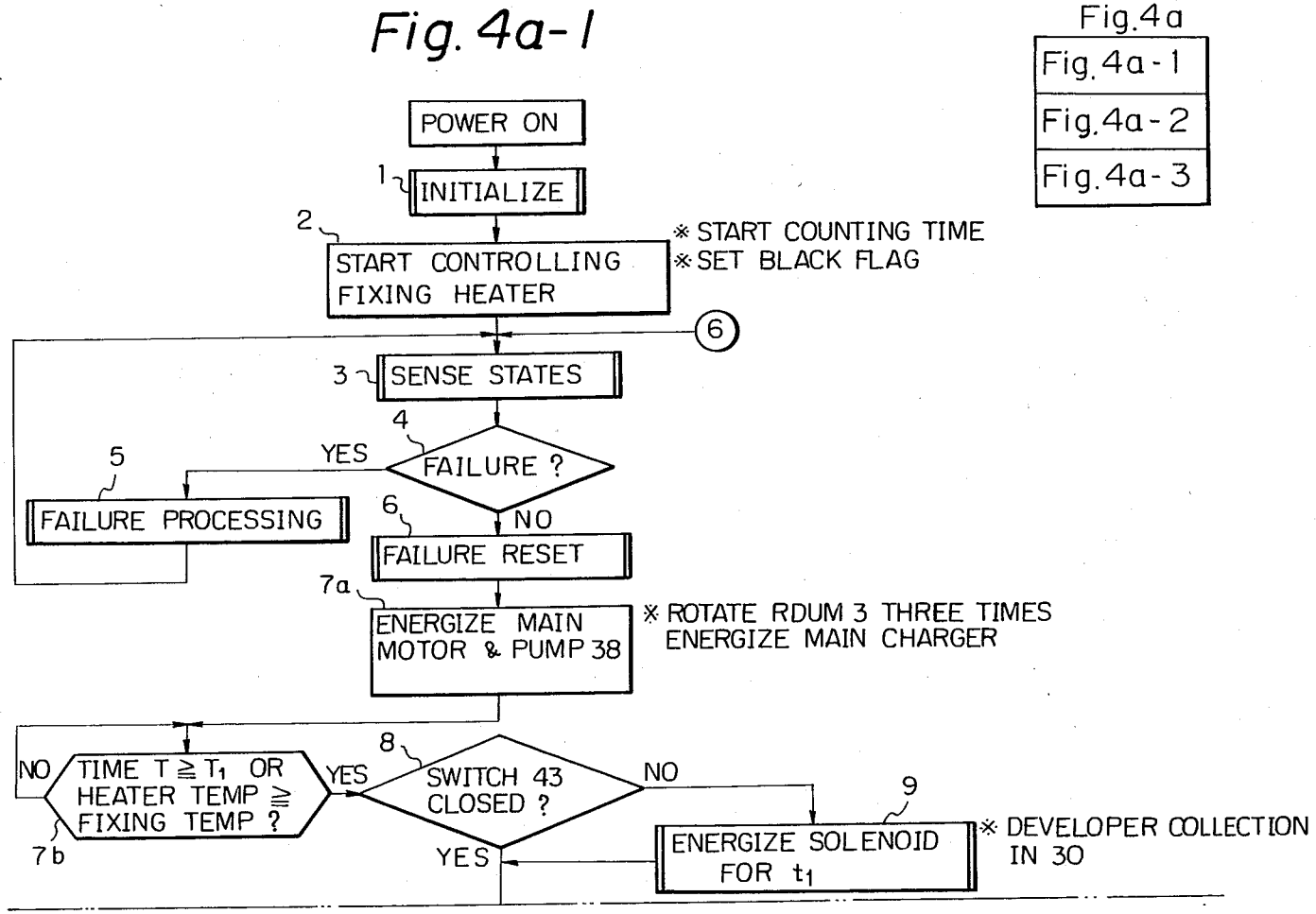
FIGS. 4*a*, 4*b*, 4*c*, 4*d*, 4*e*, 4*f*, 4*g* and 4*h* are flowcharts demonstrating the operation of a microprocessor which is included in the control system of FIG. 3.
Figures 2, 4A:
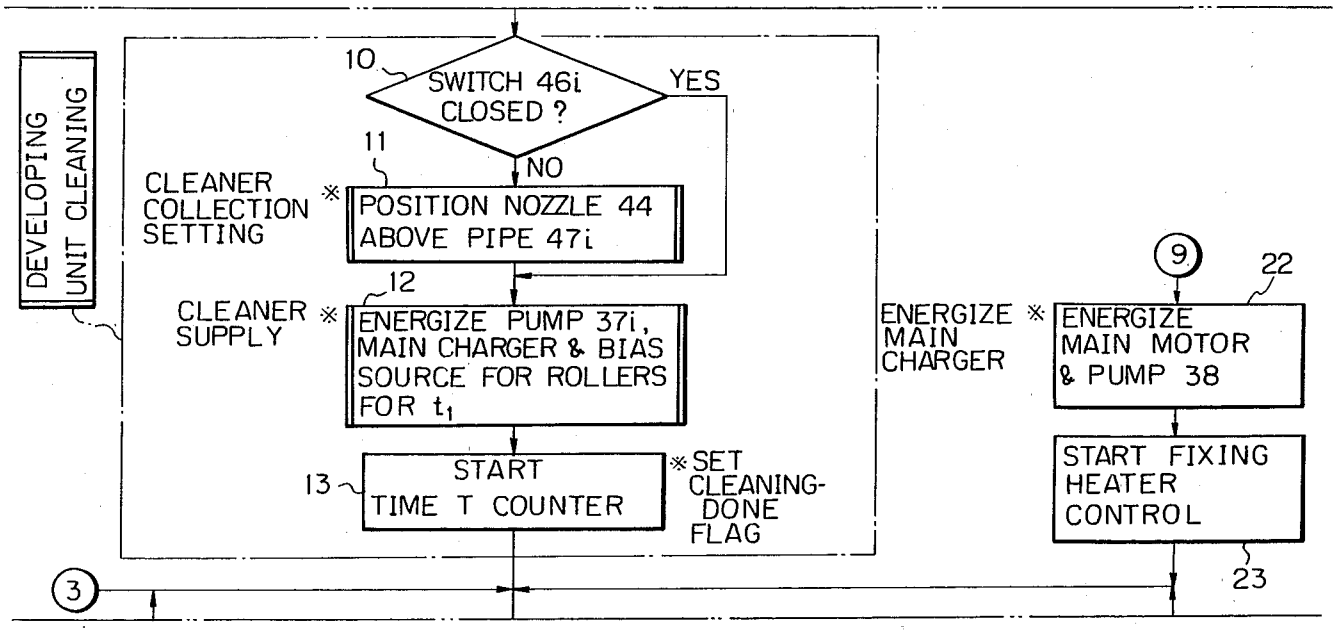
Figures 3, 4A:
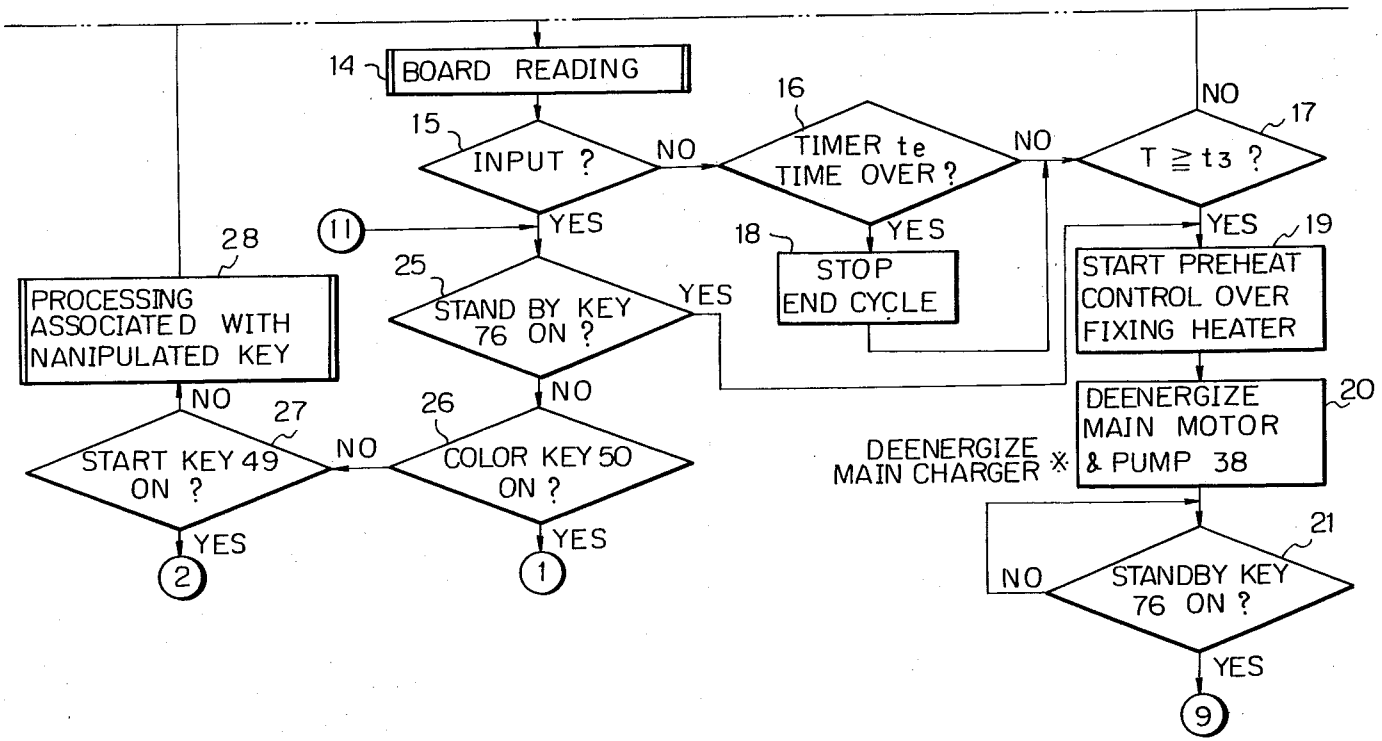

Referring to FIG. 4*a*, when the power switch of the copier is turned on to supply power to the CPU 58 and various sections of the copier, the CPU 58 performs initialization (STEP 1). The initialization is such that the various elements of the copier are rendered inoperative, counters, timers, registers built in the CPU 58 are initialized, and a status tracing register and others which are assigned to a RAM are initialized. The display on the operating board 48 is restored to a standard condition while, at the same time, data representative of the statuses set up are written into a memory, In the standard display, the copy number is 1 (one), the color is black, and the lamp 53 is turned on to set a black flag. Then, the CPU 58 starts counting time T which expires (START COUNTING TIME T).

After the initialization, the CPU 58 drives a heater driver to cause the heater of the fixing unit 24 to generate high-temperature heat (step 2). Subsequently, the CPU 58 scans the status sensing switches of the switch matrix 61 so as to check the copier for a failure (STEP 3). If any failure is found, the CPU 58 executes failure processing (STEP 5) and waits for the removal of the failure (steps 3 - 4 - 5 - 3). When no failure is found or a failure has been removed, the CPU 58 clears a failure flag, a failure display and others (STEP 6), energizes the main motor (drum 3 rotated), and energizes the pump 38 (black developer supplied to the cleaning unit 9) (step 7*a*).

Interlocked with the main motor and pump, the developing rollers 161 to 163 of the developing unit 5 are driven and, at the same time, the main charger 4 is energized. A bias voltage of the same polarity as the toner is applied to the developing rollers. Such energization of the main charger 4 and the application of a bias voltage are adapted to attract the toner in the developer, which is deposited on the surfaces of the rollers 161 to 163, toward the drum 3 to thereby collect it by the unit 9. Simultaneously, the bracket 78 is moved to the position of FIG. 2*b* so that the blade 80 and sponge roller 79 are brought into pressing contact with the drum 3 (STEP 7*a*).

Thereafter, the CPU 58 determines whether the time T counted has exceeded the draining time $T_1$. If the result is NO, the CPU 58 references the temperature of the fixing portion of the unit 24 (output of 63S) (step 7*b*). If the time T is short of the time $T_1$ and if the temperature of the fixing portion is short of a predetermined fixing temperature, the CPU 58 waits until the time T exceeds the time $T_1$ or until the temperature of the fixing portion rises beyond the predetermined one (step 7*b*). As the time T exceeds the time $T_1$ or the temperature of the fixing portion rises beyond the predetermined one, the CPU 58 decides that the developing unit 5 has been sufficiently drained or that the copier is ready to perform a copying cycle. Then, the CPU 58 checks the switch 43 to see if it has been closed (STEP 8) and, it has not been closed (outlet 29 of unit 5 communicated to first vessel 30), energizes the solenoid 42 for the period of time $t_1$ (step 9). This actuates the valve 39 to provide communication between the outlet 29 and the nozzle 44, whereby the switch 43 is closed. If the switch 43 is closed or becomes closed, the CPU 58 references the status of the nozzle position switch 46*i* (step 10). If the switch 46*i* is not closed, i.e., if the nozzle 44 is not in alignment with the pipe 47*i*, the CPU 58 references the other switches 46*r*, 46*g* and 46*b* and rotates the pulse motor 45 in the reverse direction to bring the nozzle 44 into alignment with the pipe 47*i* (step 11). When the nozzle 44 is or becomes aligned with the pipe 47*i* as stated, the CPU 58 energizes the pump 37i for the cleaning time $t_2$ so as to clean the developing unit 5 (step 12).

During this period of time $t_2$, the cleaner in the vessel 30*i* is fed to the unit 5 and returned to the vessel 30i.-Timed to the energization of the pump, the developing rollers 161 to 163 in the unit 5 are rotated and the main charger 4 is energized. At this instant, a bias voltage of the same polarity as the toner is applied to the developing rollers. Such energization of the charger and the application of the bias voltage are adapted to attract the toner in the developer, which is deposited on the rollers 161 to 163, toward the drum 3 and collect it by the unit 9, thereby enhancing the cleaning effect.

Upon the lapse of the cleaning time $t_2$, the CPU 58 starts counting the time T and sets a cleaning-done flag (STEP 13). That is, it starts counting time in order to decide whether or not the cleaner draining time $T_1$ has expired.

The steps described so far constitute a developer supply control routine, i.e., a developing unit initializing control which occurs immediately after the turnon of the power switch.

When the clean processing (step 12) is completed, the CPU 58 reads the condition of the operating board 48 (STEP 14). So long as no data is entered on the board 48, the CPU 58 sequentially and repeatedly executes steps 16, 17 and 14 awaiting an input on the board 48, awaiting the lapse of an end cycle completion time $t_e$, and awaiting the laps of a key-in waiting time $t_3$. The time $t_e$ is a period of time for executing an end cycle, i.e., continuously rotating the drum 3 for post-processing after the last one of a desired number of copies has been produced. At the instant when the final copying cycle has been completed, the end cycle is commensed and, at the same time, a timer $t_e$ (program timer) loaded with the period of time $t_e$ is triggered, then the program returning to the step 14. At a step 16, the CPU 58 determines whether the time $t_e$ is over and, if the result is YES (end of end cycle), finishes the end cycle (step 18). The key-in waiting time $t_3$ is such that when a condition wherein no data is entered on the operating board 48 continues after copy setting has been allowed (step 14), the copier is automatically restored to its standby condition upon the lapse of a predetermined period of time. As the time T reaches the time $t_3$ after copy setting has been allowed (step 14 and the end of production of set number of copies) (step 17), the CPU 58 switches the fixing heater to a preheat mode (low-temperature heat generation), turns on the light emitting element of the standby switch 76 (step 19), deenergizes the main motor, stops the operation of the pump 38, and deenergizes the main charger 4 (step 20). Then, the CPU 58 waits for the turnon of the standby switch 75 (STEP 21). It is to be noted that when the switch 76 is turned on while the standby condition is not set up, such is also detected at the step 14 so that the program advances from a STEP 25 to the STEP 19 to set up the standby condition.

When the standby switch 76 is turned on under the standby condition (step 21), the main motor and the main charger are energized, as has been the case with the step 7*a*. Further, the pump 38 is energized (step 22), the fixing heater is switched to a high-temperature mode (step 23) as in the step 2, and the CPU 58 reads the operating board 48 (step 14). When the manipulation of any of the key switches other than the standby switch 76, color command switch 26 and start key switch 49 is read (step 27) during the board read processing (step 14), read processing associated with the particular key or keys which have been manipulated is performed (step 28). Typical of such read processing is a one associated with a number of copies which is entered through the ten keys.

Figure 4B:
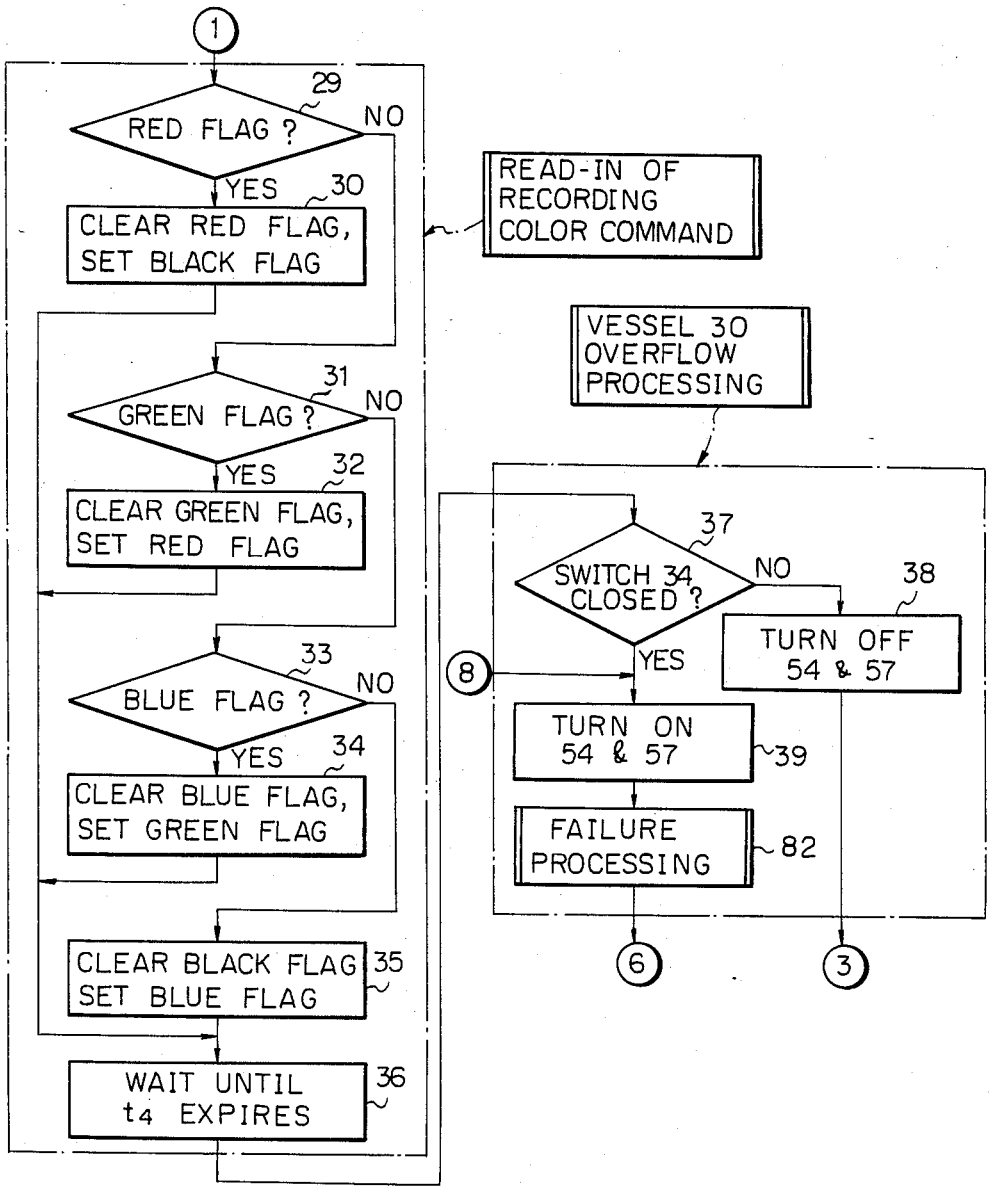

For example, when the color command switch 26 is manipulated, the CPU 58 executes the processing which extends from the step 26 of FIG. 4*a* to the commanded recording color read processing and the first vessel 30 overflow processing of FIG. 4*b*.

In detail, assume that the switch 50 is turned on for the first time after the turnon of the power switch. Then, the lamp 53 has been turned on, and a black flag has been set in the register of the CPU 58 or the register of the RAM 66 by the initialization, as performed at the step 1. Hence, the CPU 58 sequentially executes the steps 29, 31, 33 and 35. In the step 35, the black flag is cleared to turn off the lamp 53, and a blue flag is set to turn on the lamp 53*b*. Then, awaiting the lapse of a period of time $t_4$ which prevents a single switch manipulation from being read twice or more (step 36), the CPU 58 returns to the board read procesing (step 14) of FIG. 4*a* by way of the vessel 30 overflow processing, i.e., steps 37 to 39 and 82. When the color command switch 50 is depressed while the blue flag is set, the CPU 58 sequentially performs the steps 29, 31, 33 and 34. Int he step 34, the blue flag is cleared to turn off the light emitting element 53*b*, and a green flag is set to turn on the light emitting element 53*g*. Then, awaiting the laps of the period of time $t_4$ (step 36), the CPU 58 returns to the step 14 of FIG. 4*a* by way of the vessel 30 overflow processing, i.e., steps 37 to 39 and 82. When the color command switch 50 is depressed while the green flag is set, the CPU 58 sequentially advances through the steps 29, 31 and 32. In the step 32, the green flag is cleared to turn off the light emitting element 53*g*, and a red flag is set to turn on the light emitting element 53*r*. Again, awaiting the lapse of the period of time $t_4$ (step 36), the CPU 58 returns to the step by way of the vessel 30 overflow processing. When the switch 50 is depressed while the red flag is set, the CPU 58 executes the steps 29 and 30. In the step 30, the red flag is cleared to turn off the light emitting element 53*r*, and the black flag is set to turn on the light emitting element 53. Then, awaiting the lapse of the period of time $t_4$ (step 36), the CPU 58 returns to the step 14 by way of the vessel 30 overflow processing. Assuming that the switch 50 is continuously turned on, then the elements 53, 53*b*, 53*g* and 53*r* are sequentially turned on in this order substantially at the intervals of $t_4$. Hence, a desired one of black, blue, green and red can be set by depressing the switch 50 either continuously or intermittently.

As the program enters into the vessel 30 overflow processing (steps 37 to 39 and 82) by way of the recording color command read processing (step 29 to 36), the CPU 58 references the state of the switch 34 (step 37). As previously stated, under conditions in which the drum 3 is rotating inclusive of a copying condition, the pump 38 feeds black developer to the cleaning unit 9 while collecting the liquid coming out of the unit 9 into the first vessel 30. In the black record mode, the black developer is fed from the first vessel 30 to the developing unit 5 and cleaning unit 9 and collected from the latter into the former. Usually, therefore, the developer in the vessel 30 does not substantially increase but, rather, decreases due to copying. However, in the other color record modes, e.g., the red record mode, red developer is fed from the second vessel 30*r* to the developing unit 5 and collected in the same vessel, but that part of the developer which is deposited on the drum 3 and collected by the cleaning unit 9 is routed to the first vessel 30. The result is an increase in the liquid level in the first vessel 30. It follows that should the blue, green or red record mode be effected with the switch 34 closed (black developer above upper limit), the developer in the first vessel 30 might overflow. Altough the black developer overflowing the vessel 30 is expected to flow into the purifying device CA through the overflow port, in practice the developer is apt to overflow the vessel 30 due to clogging of the filter tube FL of the device CA. The vessel 30 overflow processing (steps 37 to 39 and 82) is adapted to avoid such overflow beforehand and to inform the operator of clogging of the tube FL (urging the operator to replace or clean FL). Specifically, when the switch 34 is closed (liquid level in vessel 30 above overflow port level) (step 37), the lamps 54 and 57 are turned on (step 39), then failure processing (step 82) is executed to inhibit copying, and then the program returns to the state sensing (step 3) to wait for opening of the switch 34 (completion of recovery). As the operator responds to the turnon of the lamps 55 and 57 by reducing the developer in the vessel 30 and/or replacing the filter tube FL, the switch 34 becomes open. Then, as the operator manipulates the switch 50, the CPU 58 sequentially executes the steps 14, 15, 25, 26, recording color read command read processing of FIG. 4*b*, 37 and 38, thereby turning off the lamps 54 and 57. If the switch 34 is maintained closed, the lamps 54 and 57 are turned on with the red lamp of the print key 49 not extinguished, so that a copying cycle is not started.

Figures 1, 4C:
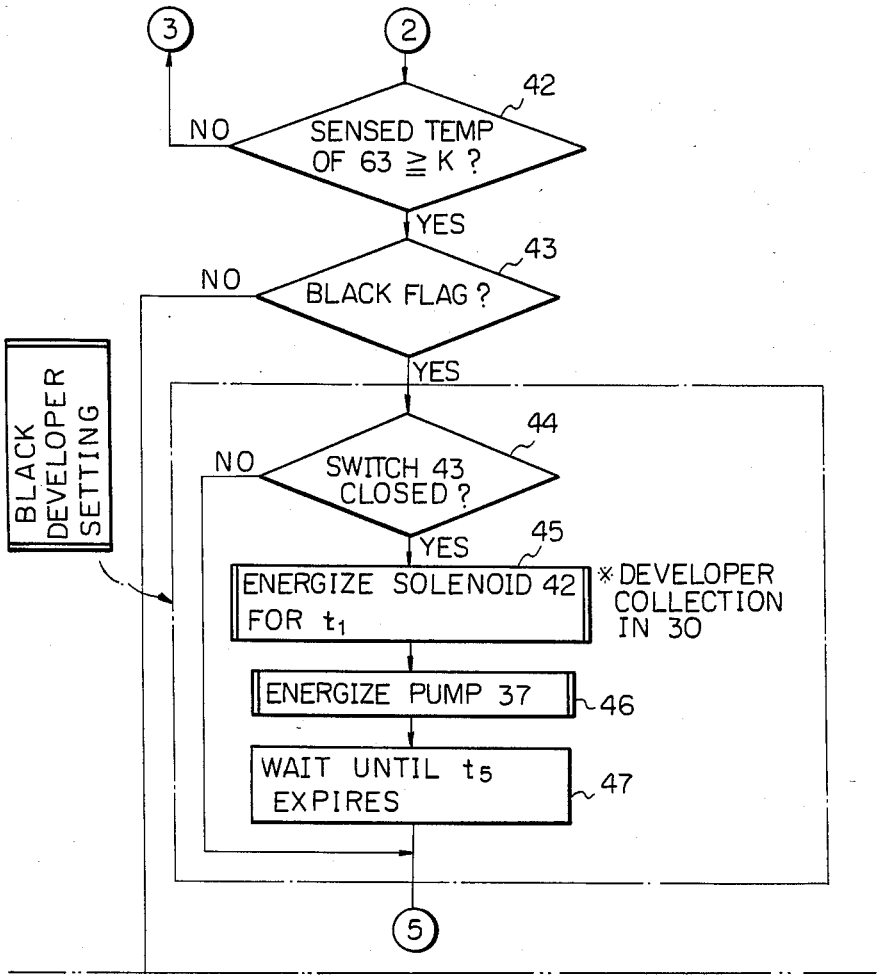
Figures 2, 4C:
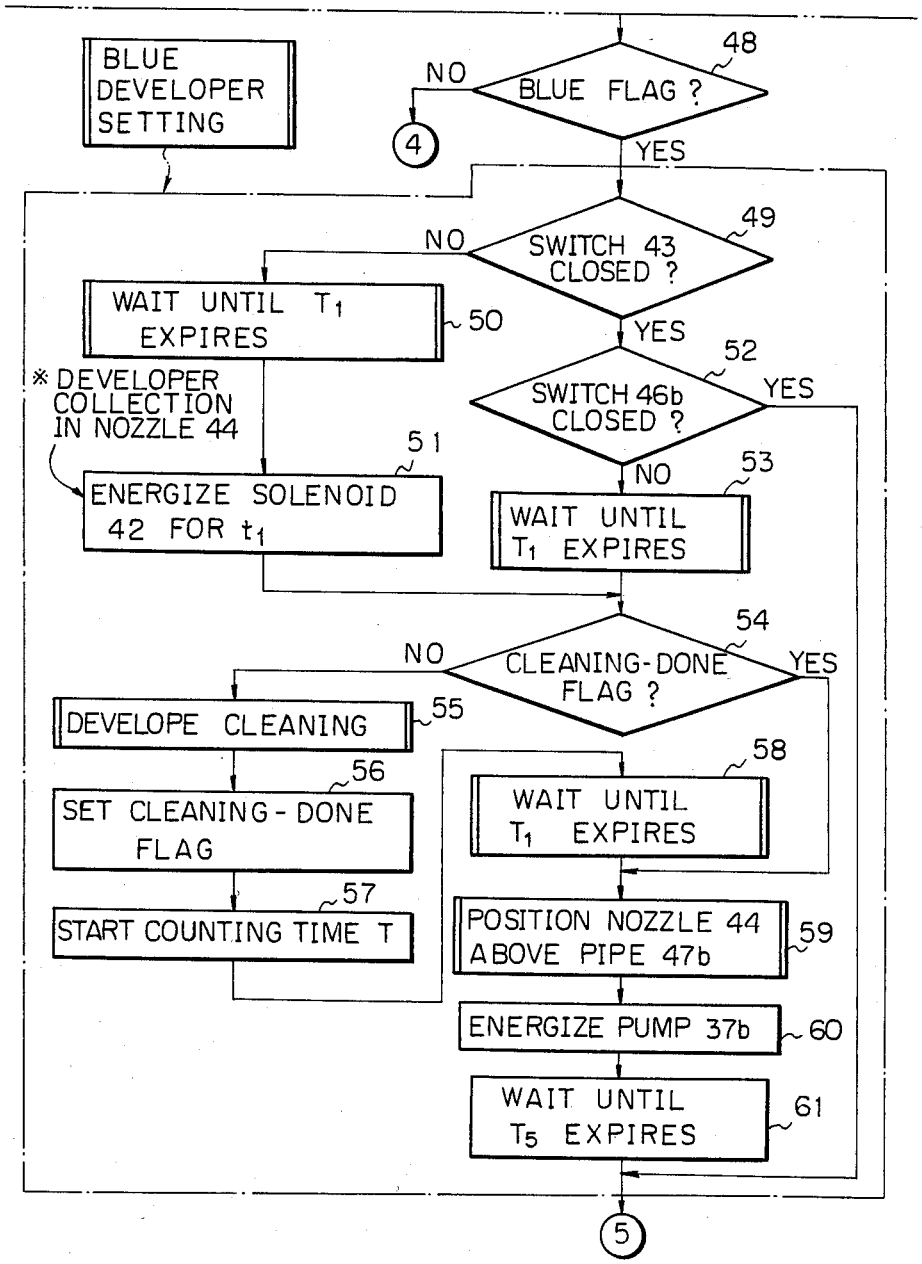

When the CPU 58 has detected by the board read processing (step 14 of FIG. 4*a*) that the printed start switch 49 is closed, it advances to a step 42 of FIG. 4*c* by way of the steps 15, 25, 26 and 27. In the step 42, the CPU 58 references the fixing temperature of the fixing portion of the unit 24 to see if it is higher than a predetermined fixing temperature K. If it is lower than K, the program returns to the step 14. When the actual temperature is lower than K, the red light emitting element of the start switch 49 glows; when it is higher than K, the green light emitting element glows on condition that the copier is at the board reading condition.

Figures 1, 4D:
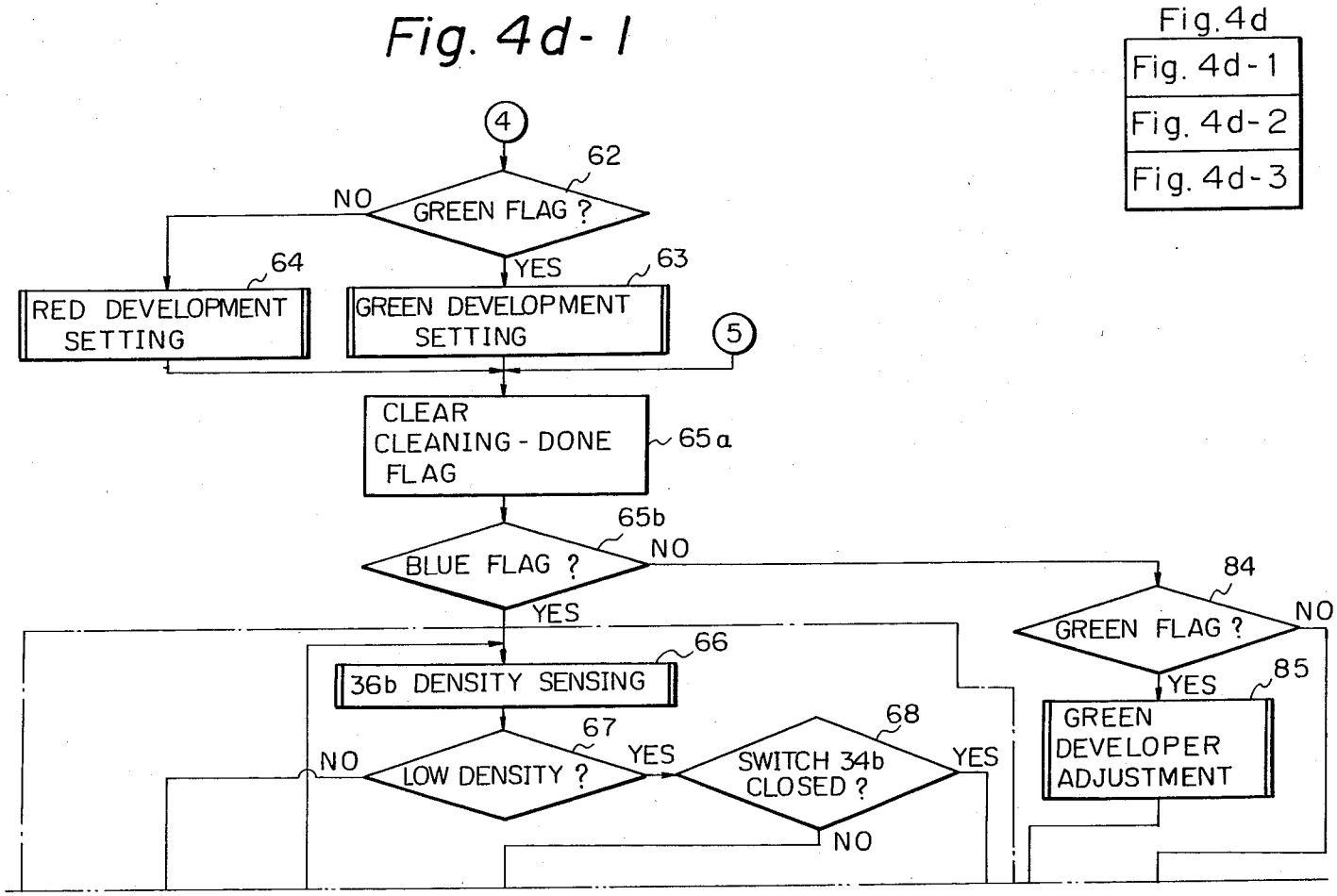
Figures 2, 4D:
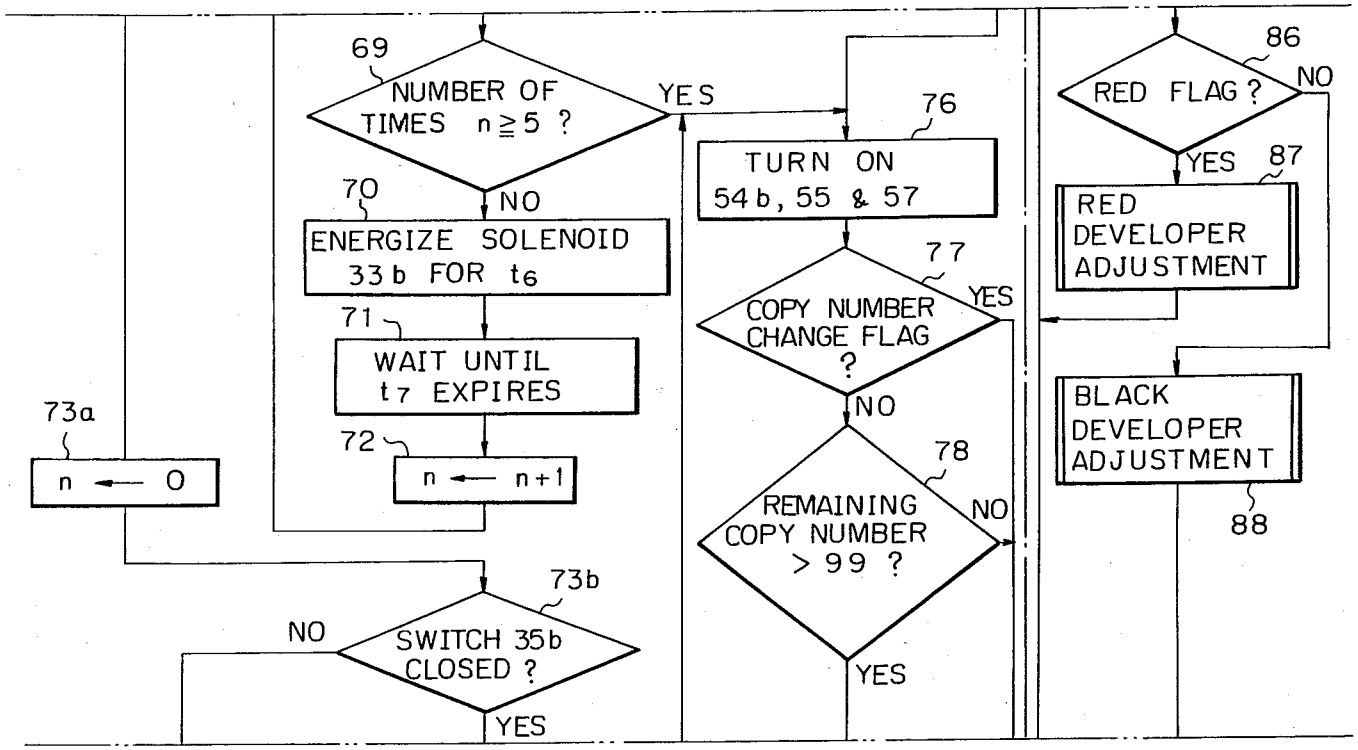
Figures 3, 4D:
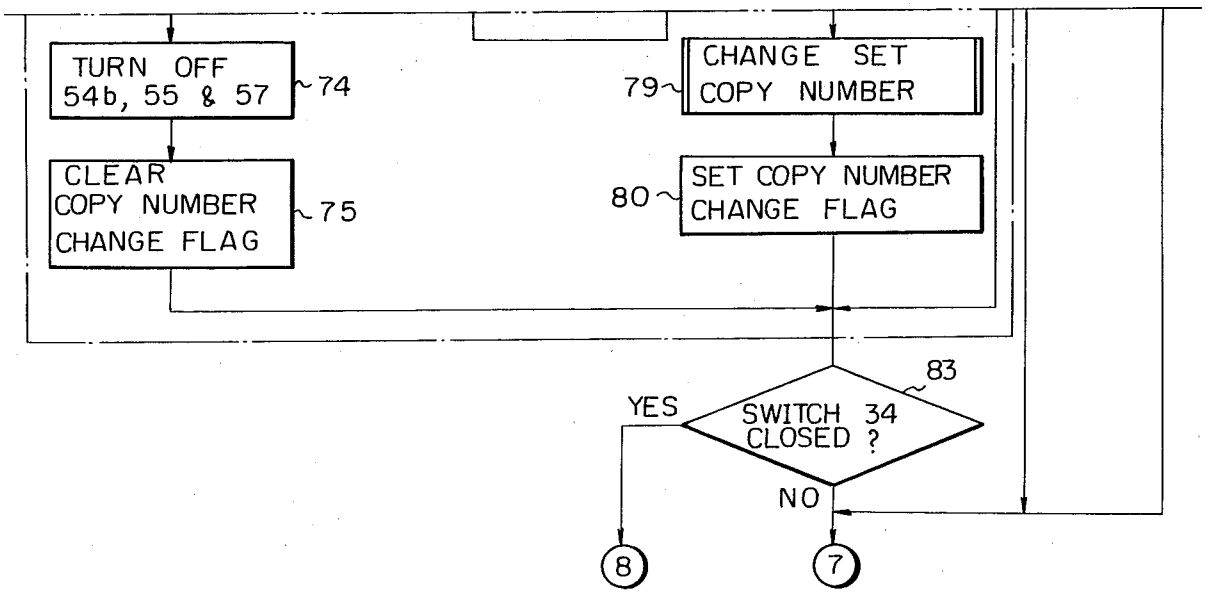

If the temperature mentioned above is higher than K, the CPU 58 advances from the step 42 to a step 43 to see if the black flag is present. If it is absent, the CPU 58 executes black development setting as represented by steps 44 to 47 in FIG. 4*c*. Specifically, the CPU 58 checks the state of the switch 43 and, if it is not closed, executes developer adjustment as shown in FIG. 4*d* becuse the valve 39 has been positioned to communicate the developing unit 5 to the first vessel 30. If the switch 43 is closed, implying that the valve 39 has communicated the unit 5 to the nozzle 44, the CPU 58 energizes the solenoid 42 for the period of time $t_1$ so as to switch the valve 39 to the vessel 30 side (step 45) and, then, energizes the pump 37 (step 46). Upon the lapse of a period of time $t_5$, which allows the black developer from the vessel 30 to be distributed to the rollers 161 to 163, the CPU 58 executes the developer adjustment as shown in FIG. 4*d*. In this black development setting (black record mode setting), it is noteworthy that awaiting the lapse of the period of time $T_1$ for the previous developer in the unit 5 to be drained, the period of time $t_2$ for the cleaner to be supplied to the unit 5 to clean it, and the period of time $T_1$ for the cleaner to be drained are needless.

If the black flag is not absent, the CPU 58 determines whether the blue flag is present (step 48). If it is set, the CPU 58 executes blue development setting as represented by steps 49 to 61. Specifically, the CPU 58 references the state of the switch 43 (step 49) and, if it is closed, references the state of the switch 46*b* (step 52). When both of the switches 43 and 46*b* are closed, they indicate a condition wherein the valve 49 is in communication with the nozzle 44 and the nozzle 44 is located above the pipe 47*b*, establishing communication of the unit 5 with the fourth or blue developer vessel 30*b*. Such implies that the copying processing performed immediately before is blue copy processing and, therefore, draining and cleaning the unit 5 is needless. Hence, the CPU 58 directly advances to the developer adjustment as shown in FIG. 4*d*. When the switch 43 is not closed, it implies that black copy processing was performed immediately before so that the CPU 58 awaits the lapse of the period of time $T_1$ for deciding the drain of the black developer from the unit 5 (step 50 shown in FIG. 4*f* and described in detail later), then energizes the solenoid 42 for the period of time $t_1$ to switch the valve 49 toward the nozzle 44 side (step 51), and then references the cleaning-done flag (step 54). The cleaning-done flag shows the fact that the copier has fully cleaned the unit 5. Therefore, if the cleaning-done flag is set, the CPU 58 brings the nozzle 44 into alignment with the pipe 47*b* (step 59), then energizes the pump 37*b* (step 60), awaits the lapse of the period of time $t_5$ for the distribution of the blue developer to the rollers 161 to 163 (step 61), and then advances to the developer adjustment of FIG. 4*d*. If the cleaning-done flage is absent at the step 54, what is meant is that the black, green or red developer was present in the unit 5 immediately before, This requires cleaning because it is the blue developer that is to be supplied this time and, hence, the CPU 58 cleans the unit 5 (step 55). This clean processing (step 55) is identical in content with the steps 10 to 13 of FIG. 4*a*. It is to be noted that at the clean processing (step 55) counting of the time T begins as in the step 13. Subsequently, the CPU 58 sets the cleaning-done flag (step 56), then starts counting the time T (step 57), and then awaits the lapse of the time $T_1$ (step 58). What is meant by "WAIT UNTIL $T_1$ EXPIRES" (steps 50, 53 and 58) is shown in detail in FIG. 4*f*.

Figure 4E:
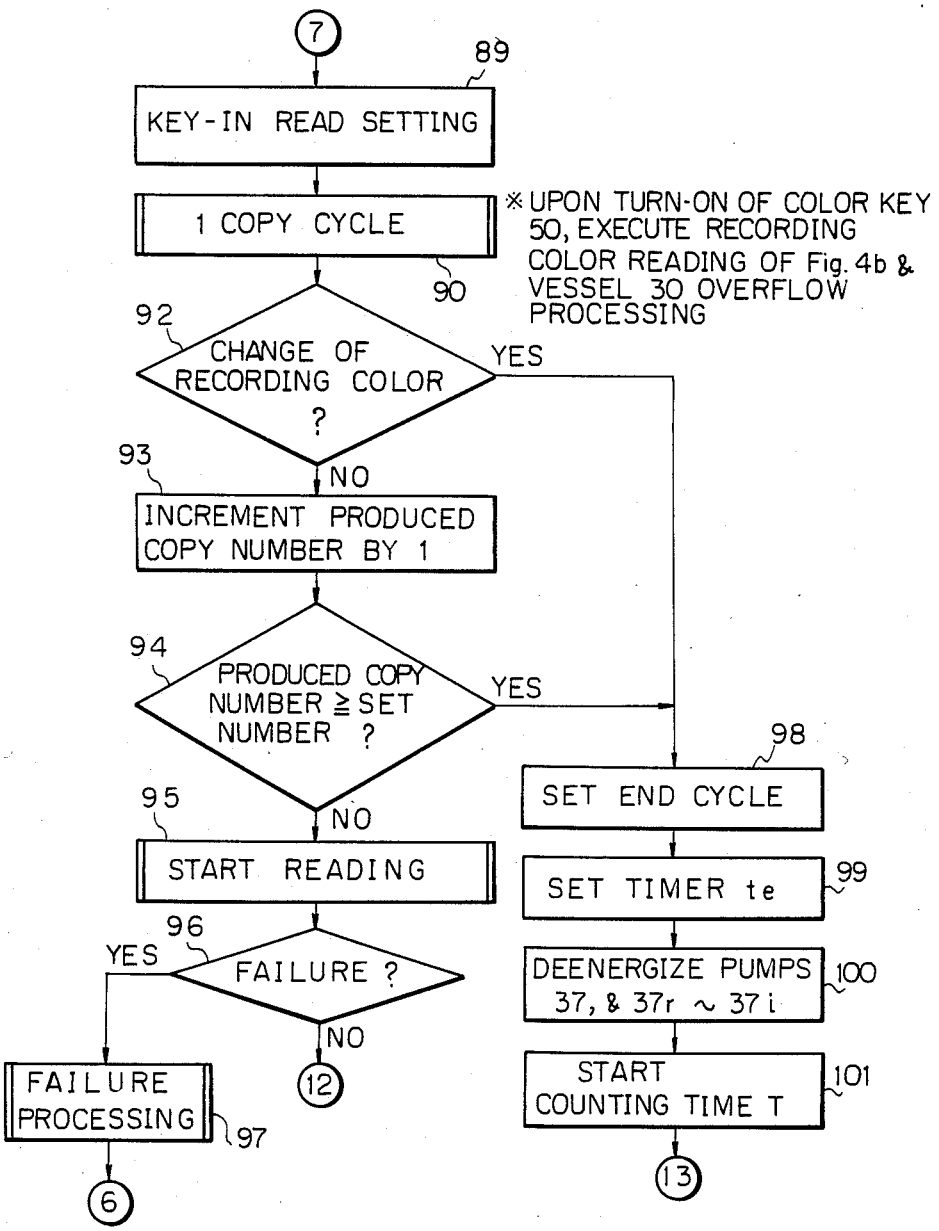
Figure 4F:
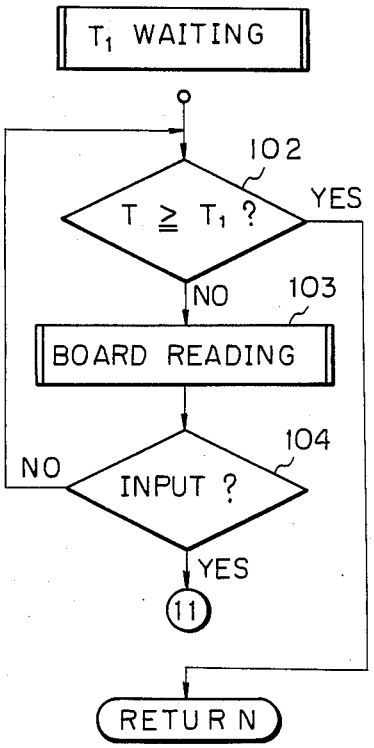

Specifically, as shown in FIG. 4*f*, the CPU 58 decides whether or not the time T counting of which had begun as stated above has reached the time $T_1$ (step 102) and, if not, waits until $T_1$. While awaiting the lapse of $T_1$, the CPU 58 performs board read processing (STEP 103) and, upon entry of any data on the operating board 48, advances the step 25 of FIG. 4*a* to execute processing associated with the data entered. It may therefore occur that the recording color command is changed while the CPU 58 is awaiting the lapse of $T_1$. If the cleaning-done command is present when the recording color command is changed, it implies that the unit 5 is fully clean. Absence of the cleaning-done flag suggests the need for cleaning. Here, it is noteworthy that the steps 50, 53 and 58, i.e., "WAIT UNTIL $T_1$ EXPIRES" is positioned before nozzle 44 positioning (step 59), and that the position of the nozzle 44 is not changed to a one which corresponds to the color flag. Even if the CPU 58 detects a manipulation of the switch 50 by the board read processing of "WAIT UNTIL $T_1$ EXPIRES" (steps 50, 53 and 58; FIG. 4*f*) and, thereby, changes the recording color (color flag), no error occurs in the nozzle positioning control because the nozzle 44 is maintained in the previous developer draining position as set up by the previous color setting (color flag), in which no copying cycle was effected. When the cleaning-done flag is present when the recording color (color flag) is changed, the clean processing (step 55) and the cleaner draining time $T_1$ wait processing (step 58) are not performed and, therefore, the previous cleaning processing is not wasteful. The interval between the change of recording color (color flag) and the start of a copying cycle is shortened.

If the black flag is absent and so is the blue flag, the CPU 58 references the presence/ absence of the green flag (step 62). If the green flag is present, green development setting (step 63) is executed. The green development setting is essentially similar to the blue development setting (steps 49 to 61) except that "46*b*" of the step 52 should be intepreted as "46g", "47b" of the step 59 as "47g", and "37b" of the step 60 as "37g".

If none of the black, blue and green flags is present, the CPU 58 automatically decides that a red flag is present and, therefore, executes red development setting (step 64) which is essentially similar to the blue development setting (steps 49 to 61). Here, "46b" of the step 52 should be intepreted as "46r", "47b" of the step 59 as "47r", and "37b" of the step 60 as "37r".

As the development setting is executed as described above, the pump 37 (step 46), 37b (step 60), 37g (step 63) or 37r (step 64) is energized and, therefore, cleaning the unit 5 is required when the recording color is changed subsequently (not required when the color is changed from blue, green or red to black). The CPU 58, therefore, clears the cleaning-done flag (step 65a) and, then, advances to the developer adjustment which follows the step 65a.

In the developer adjustment, the CPU 58 references the presence/absence of the blue flag first (step 65b). If it is present, the CPU 58 sees that the pump 37b is being energized to feed the blue developer from the fourth vessel 30b to the developing unit 5, and that the drain from the unit 5 is being returned to the vessel 30b by way of the density sensing unit 36b. In this condition, the CPU 58 executes blue developer adjustment (steps 66 to 80). Specifically, the CPU 58 converts an analog output voltage of the photoelectric transducer of the density sensing unit 36b (FIG. 3) into digital data and compares the digital value with a reference value (step 66). If the density represented by the digital data is greater than the predetermined value, meaning that the current developer density is appropriate, the CPU 58 sets (or clears) the number n of developer supply done to 0 (zero) (step 73a) and, then, references the state of the switch 35b (step 73b). If the switch 35b is not closed, meaning that the liquid level in the fourth vessel 30b is appropriate, the CPU 58 turns off the trouble indicators 54b, 55 and 57 (step 74), clears a copy number change flag (step 75), and advances to a step 83. If the switch 35b is closed, indicating that the developer is short (at least the diluent container 32b is empty), the CPU 58 turns on the indicators 54b, 55 and 57 (step 76) and compares the remaining number of copies with 99. If it is not greater than 99, the condition is left as it is. If it is greater than 99, the CPU 58 updates the copy set number (step 79) such that the remaining copy number becomes 99 and, then, sets a set copy number change flag (step 80). That is, the CPU 58 makes the number of copies which may be produced thereafter not greater than 99. If the set copy number change flag is set when the lamps are turned on in the step 76, the set copy number is not changed because such a change of set copy number has already been performed.

When the density is found short of the predetermined one by the step 66, the CPU 58 references the state of the switch 34b (step 68). If it is closed, the CPU 58 executes the previously described set copy number change processing (steps 76 to 80) because supplying the developer from the container 31b to the fourth vessel 30b under the above condition is apt to cause the developer to overflow. So far as the switch 34b is not closed, there is no fear of overflow and, therefore, the CPU 58 references the current number n of developer supply done and, if it is less than 5 (step 69), energizes the solenoid 33b for a period of time $t_6$ (step 70). This maintains the container 31b open for the duration of $t_6$ so as to feed the developer from the container 31b to the vessel 30b. Subsequently, the CPU 58 waits until a period of time $t_7$ which is long enough for the developer supplied to reach the developing unit 5 mixed with the developer of the vessel 30b and then the density sensing unit 36b expires (step 72). Upon the lapse of the time $t_7$, the CPU 58 increments the number n by 1 and, then, senses density (step 66). If the density sensed sensed in the step 66 is still short, the developer is supplied again from the container 31b to the vessel 30b (steps 69 to 72). When the density is increased beyond the reference value, the CPU 58 advances from the step 67 to a step 73a to exit the developer supply flow. However, if a density higher than the reference value is not reached even after five consecutive times of developer supply (meaning that the container 31b is empty), the operation is transferred to the set copy number change processing, step 76 to 80.

As the CPU 58 advances to a step 83 after the developer adjustment as stated above, the CPU 58 checks the state of the switch 34. If it is closed, implying the fear that the liquid in the first vessel overflows due to clogging of the filter tube FL, the operation is transferred to the overflow processing as represented by the steps 39 and 80 of FIG. 4b. If the switch 34 is not closed, the operation advances to a copy control flow as shown in FIG. 4e.

While blue developer adjustment under the presence of the blue flag has been described, green developer adjustment (steps 84 and 85) under the presence of the green flag proceeds in the same manner as the blue developer adjustment except that "36b" of the step 66 should be interpreted as "36g", "34b" of the step 68 as "34g", "54b" of the steps 74 and 76 as "54g", "33b" of the step 70 as "33g", and "35b" of the step 73b as "35g". Red developer adjustment (steps 86 and 87) is similar to the blue developer adjustment except that "36b" of the step 66 should be interpreted as "36r", "34b38 of the step 68 as "34r", "54b" of the steps 74 and 76 as "54r", "33b" of the step 70 as "33r", and "35b" of the step 73b as "34". Further, black developer adjustment (step 88) is similar to the blue developer adjustment except that "36" of the step 66 should be interpreted as "36", "34b" of the step 68 as "34", "54b" of the steps 74 and 76 as "54", "33b" of the step 70 as "33", and "35b" of the step 73b as "35".

Referring to FIG. 4e, the copy control begins with a step 89 where data keyed in through the operating board 48 is to be read. Then, one copy cycle is commenced (step 90) so that copying processing which is known in the art is effected once. When any data is keyed in while the copying cycle is under way, the CPU 58 stores data which is representative of the manipulated key switch. Assuming that the color command switch 50 has been manipulated, a color flag of that instant is stored as a preceding color flag and, then, processing which is similar to that of FIG. 4b is executed. This results the fact that the color being used (preceding color flag) and the color flag just set are different from each other. Upon completion of one copying cycle (step 90), the CPU 58 determines whether or not the color flag has been changed (step 92) and, if not, increments the content of a produced copy number register by 1 (step 93) and compares the resultant content of that register with the set copy number register (step 94). If the number of copies produced is smaller than the set number, meaning that another copy processing (step 90) is necessary, the CPU 58 reads the states of various sections of the copier (step 95) to see if copy processing may be continued (step 96). If the result is NO, the operation is transferred to failure processing (step 97). If the copier is free from failures and allows copy processing to be continued, the CPU 54 returns to the step 89 of the copy control by way of the flow of FIG. 4g, i.e. distribution control (steps A1 to A14) over the liquid (diluent) collected by purifying device CA in the black record mode. If the number of copies produced is greater than the set number or if the color flag is changed during the one copy cycle (step 90), the CPU 58 sets the end cycle for post-processing (step 98), sets the $t_e$ timer for determining the end of the end cycle (step 99), deenergizes the developer supply pumps 37, 37r, 37g and 37b (step 100), and starts counting the time T (step 101). Subsequently, the program returns to the board reading (STEP 14) of FIG. 4a.

Because the pumps 37, 37r, 37g and 37b have been deenergized at the step 100 as stated above, the developers are not supplied to the developing unit 5 any longer; each of the developers in the unit 5 flows down by gravity into the vessel 30, 30r, 30g or 30b. That is, drainage of the developers beings and, therefore, the time T being counted is indicative of the duration of drainage as well as the period of time which has expired since the end of the copying operation.

As the CPU 58 returns to the step 14 after the completion of the copying operation, it sequentially executes the steps 14, 15, 16, 17 and 14 waiting for the end of the end cycle (time $t_e$ over) as well as for the elapse of the time $t_3$, where $t_3$ is longer than $t_e$. If any data is entered on the operating board 48 before the time $t_e$ expires, the CPU 58 starts on the control which is represented by the step 25 and onward. If the time $t_e$ expires with no data entry on the board 48, the CPU 58 stops the end cycle (step 18) by stopping the rotation of the drum 3, deactivating the other mechanical sections, deenergizing the pump 38, and deenergizing the main charger 4. Upon the lapse of the time $t_3$, the CPU 58 sets up the standby condition (steps 19 and 20) and waits until the standby switch 76 becomes turned on (steo 21). As the switch 76 is turned on, the CPU 58 energizes the main motor, the pump 38 and the main charger 4 (step 22) and, then, advances to the step 14.

Next, the distribution control (steps A1 to A14 of FIG. 4g) over the liquid (diluent) collected by the device CA in the black record mode will be described.

First, the CPU 58 checks the state of the switch 34 (step A1). If it is closed, suggesting that the first vessel 30 may advances to the overflow processing (steps 39 and 82) of Fig. 4b. If the switch 34 is closed, meaning that the filter tube FL can absorb at least that developer which flows out through the overflow port of the vessel 30, the CPU 53 sees if the black flag is present (step A2). If it is present, the program enters into a recording operation in which the developer is supplied from the vessel 30 to the developing unit 5 and returned from the latter to the former via the valve 39. Assuming that the developer has flown into the overflow port of the vessel 30, a diluent separated by filtering the developer is delivered to any of the second to third vessels and the cleaner vessel. However, because the vessel at the destination is apt to overflow if the liquid level therein has reached the upper limit, the CPU 58 sequentially checks the states of the upper limit switches 34i, 35b, 34g and 34r of the second to fourth vessels and cleaner vessel in this order in steps A3, A6, A9 and A12, respectively. That is, the cleaner vessel 30i, the blue developer vessel 30b, the green developer vessel 30g and the red developer vessel 30r are sequentially selected in this order as a destination. Specifically, if the switch 34i is open as determined in the step A3 (cleaner level short of upper limit), the CPU 58 positions the nozzle 44 above the pipe 47 in the steps A4 and A5. If the switch 34i is closed (cleaner level reached the upper limit), the CPU 58 checks the state of the switch 34b (step A6) and, if it is open (blue developer short of upper limit), positions the nozzle 44 above the pipe 47b in the steps A7 and A8. If the switch 34b is closed (blue developer reached upper limit), the CPU 58 checks the state of the switch 34g (step A9) and, if it is open (green developer short of upper limit) brings the nozzle 44 into alignment with the pipe 47g at the steos A10 and A11. If the switch 34g is closed (green developer reached the upper limit), the CPU 58 checks the state of the switch 34r (step A3) and, if it open (red developer short of upper limit), positions the nozzle above the pipe 47r in the steps A13 and A14. If the switch 34r is closed (red developer reached upper limit), the CPU 58 now sees that all the switches 34i, to 34r are closed and, therefore, all the vessels are apt to overflow when supplied with the diluent. Under this condition, the CPU 58 turns on the lamps 54, 54i, 54b, 54g, 54r and 57 (step A15) while executing the steps 39 and 82 of FIG. 4b to inhibit copying.

Hereinafter will be described the processing (steps 110 to 121 of FIG. 4h) which is to be executed at the end of color copying.

In this processing, the CPU determines whether or not the black flag is present to see if it is color copying which was completed by the copying cycle (step 110). If the copying completed is not color copying, i.e., if it is black copying, the CPU 58 returns to the step 14 of FIG. 4a. If the copying completed is color copying, the CPU 58 checks the state of the nozzle position switch 46i of the nozzle 44 (step 111). A closed position of the switch 46i shows that the nozzle 44 is aligned with the cleaner vessel 30i and, therefore, prepared for cleaning the developing unit 5 as will be needed in the event of the next change of recording color, the CPU 58 advancing to steps 118 to 121. If the switch 46i is not closed, meaning that the nozzle 44, or drain system, is maintained in the immediately preceding green drain condition, the CPU 58 waits until a time $t_8$ expires. The time $t_8$ is longer than a time which is necessary for the developer remaining in the drain system to be collected in the developer vessel, and it may be five seconds, for example. When the time $t_8$ has expired with no data entered on the operating board 48 and no manipulation for copying performed (steps 112, 113 and 114), the CPU 58 positions the nozzle 4 above the pipe 47i so as to communicate the drain system to the cleaner vessel (step 116). This prepares the drain system for cleaning which will occur when the recording color is changed thereafter. During this period of time, the CPU 58 reads the board 48 (step 113) and, if any data is entered (step 114), the operation is returned to the step 25.

In a recording apparatus of the type described, because copying in black occurs more frequently than the others, the black record mode is used as a standard mode. Hence, if the copier is not manipulated for copying even after a predetermined period of time has elapsed since the end of color copying, the CPU 58 executes steps 118 to 121 which are adapted to set the black flag to thereby set up the black or standard copy mode. Specifically, the CPU 58 sets the black flag while clearing the other color flags (step 121) after positioning the nozzle 44 above the pipe 47i or, if the switch 48i is closed, when a predetermined period of time $t_9$ (e.g. one minute) has expired with no data entered on the board 48 and no manipulation for copying performed (steps 118, 119 and 120). Then, the CPU 58 returns to the step 14 of FIG. 4*a* to read the operating board 48 and, if any data is entered (step 114), returns to the step 25.

Major ones of the control procesures as performed by the CPU 58 will be summarized hereinafter.

(1) Black record mode setting upon power-on: By the initialization which immediately follows the turnon of the power, the black flag is set (step 2) with black recording set up on the memory. In a copier of the type described, black copying presumably occurs most frequently and, for this reason, black is selected as a recording color which is one of standard copying conditions. However, the developer is not supplied to the developing unit 5 immediately after black has been set up on the memory. This is because another color may be commanded afterwards through the operating board 48; assuming that the supply of black developer to the unit 5 has already been initiated, there are needed stopping the supply of black developer, and awaiting the lapse of the black developer draining time $T_1$, the cleaning time $t_2$, and the cleaner draining time $T_1$, lowering the operating efficiency of the copier.

(2) Waiting immediately after power on: As the power source is turned on, the program starts counting the time T (step 2) and waits until the time T reaches $T_1$ or until the temperature of the fixing unit 24 reaches a predetermined one (step 7*b*).

Whether or not the time $T_1$ for draining the developer which has been used immediately before has expired is uncertain. An operation manual and others instruct that the power source of the copier should be turned off after the end cycle and, so long as the operator accedes to this instruction, $T_1$ surely expires before the turnoff of the power source; the draining time $T_1$ is needless when the power is switched on afterwards. However, it may occur that the power is switched off during or immediately after copying and, then, switched on again before $T_1$ expires, although the probability is not great. In the light of the above, this particular embodiment is in principle such that the lapse of the draining time $T_1$ is unconditionally waited for after the turnon of the power source. When the power is switched on while the fixing unit 24 is at room temperature, the period of time necessary for the fixing portion to reach the predetermined fixing temperature is longer than the time $T_1$. Hence, waiting until the draining time $T_1$ expires immediately after the turnon of the power source does not invite any noticeable reduction in the operating efficiency of the copier. However, when the power is switched off after the end cycle and, then, switched on immediately (this occurs with substantial probability), the lapse of $T_1$ is not waited for after the turnon of the power because the temperature of the fixing portion is relatively high and, usually, the draining time T will have been expired then after the end of the previous copying operation.

(3) Cleaning after draining cleaner: During the standby condition as stated above in the control (2), the developer is sufficiently drained from the developing unit 5. Whether or not data will be key in through the board 48 immediately after the standby condition is uncertain and, in addition, which one of the recording colors will be commanded is not known at all. When the power is switched on while the fixing unit 24 is at room temperature (e.g. upon the first turnon of the day), the fixing portion is waiting for warm-up and has not reached the fixing temperature. Therefore, the developing unit 5 is cleaned at this stage (step 12).

During this cleaning period, at least the main charger 4 is energized so that the toner on the rollers of the unit 5 is transferred to the drum 3 and thereby removed from the rollers. This correspondingly reduces the contamination of the cleaner. Interlocked to the main charger, the rollers 161 to 163 of the unit 5 are rotated with a bias voltage of the same polarity as the toner applied thereto. The energization of the charger 4 and the application of the bias voltage serve to transfer the toner in the developer on the rollers 161 to 163 to the drum 3 and, then, collect it in the unit 9, whereby the contamination of the cleaner is reduced. At the same time, they serve to shorten the time necessary for the unit 5 to be cleaned.

(4) Waiting for drain after cleaning: After cleaning has been completed, the lapse of the period of time $T_1$ which the cleaner takes to sufficiently flow out of the unit 5 is waited for. During this period of time, the operating board 48 is read (steps 13 and 14).

(5) Setting recording color: When the operation of each of the color command switches is read by the board reading (steps 14, 103, 113 and 118), a recording color is set up accordingly (steps 29 to 41).

(6) When the manipulation of the start switch 49 is read by the board reading (steps 14, 103, 113 and 118), the development setting (steps 42 to 64; developer supply to unit 5) is executed on condition that various sections of the copier other than the developing section are ready to operate. Then, after the developer adjustment (steps 65*b* to 83), the program advances to the copy processing (steps 89 to 101).

(7) In the development setting as stated in (6), the actual developer supply setting and the developer supply required this time are compared.

(7-1) If they are identical with each other, the program directly advances to the developer adjustment. Hence, so long as the recording color command is not changed, the copier starts on a copying operation in response to the manipulation of the start key switch as smoothly as an ordinary monochromatic copier.

(7-2A) If they are not identical with each other, (7-2A-1) the lapse of the draining time $T_1$ for the developer used last time is waited for (steps 50 and 53), then cleaning is effected (step 55), and then the draining time $T_1$ for the cleaner is waited for (step 58). Thereupon, the program advances to the developer adjustment.

(7-2A-2) If the cleaning-done flag is present, the lapse of the cleaner draining time $T_1$ is waited for (step 58) with the draining time $t_1$ for the developer used last time (steps 50 and 53) and the execution of cleaning (step 55) omitted, because the unit 5 has just been cleaned.

(7-2A-3) While the passage of the draining time $T_1$ is waited for, the board reading (steps 103) is performed and, in response to an input, the program advances to the above-stated (5).

(7-2B) IF the color required this time is black, the above procedures (7-2A-1), (7-2A-2) and (7-2A-3) are not executed. Hence, the interval between the entry of a black command and the start of black copying is far shorter than in the case with any of the other colors.

(7-3) When the developer supply pump 37, 37*r*, 37*g* or 37*b* is energized, the cleaning-done flag is cleared (STEP 65*a*).

(8) If the developer density is short as determined by the developer adjustment, the developer is fed from the developer container to the vessel. If this still fails to increase the density to a sufficient degree, the set copy number is changed such that the actual copy number allowed thereafter becomes not greater than 99. That is, when the density or the amount of the developer is short, the number of copies which may be produced thereafter is limited to 99 at maximum to insure quality reproduction. When the developer level is at the upper limit, the developer supply is stopped in order to prevent it from overflowing and, therefore, the density is short. In this case, too, limiting the number of copies to be produced is desirable.

(9) Even during one copying cycle, the operating board 48 is read to store an input if any. Upon completion of one copying cycle, the memory is referenced and, if the recording color command has been changed (step 92), the end cycle is set so that the operation returns to the step 14.

(10) As the copying operation is finished, the timer is set for deciding the end of the end cycle (step 99) while, at the same time, counting of the time T begins (step 101) to see the time for which the copier is left unused after the copying operation and to monitor the drain of the developer from the unit 5.

(11) After the copying operation, whether or not the copying finished is color copying is determined (step 110). If the result is YES, the lapse of the time $t_8$ is waited for and, if no data is entered and no manipulation for copying is performed during the period of time $t_8$, the cleaner vessel is selected for the collection of the developer (step 116). Why such is performed is that when color copying was performed last time and a certain period of time has passed thereafter, the probability that the recording color will be changed for the next operation is high, requiring the program to enter into the cleaning operation rapidly for the next processing. Further, upon the lapse of the time $t_9$, the black flag is set (step 121) because upon the lapse of such a period the color command is changed from a color other than black to black with high probability. During those waiting times $t_8$ and $t_9$, the operating board 48 is read (steps 113 and 119) and, if any data is entered (steps 114 and 120), exits this flow to return to the step 25. This allows the copier to start on a copying operation as rapidly as an ordinary monochromatic copier in response to the depression of the start key switch.

(12) Thereafter, as the time $t_e$ expires with no data entered on the operating board 48 (start switch 49 OFF), the end cycle is stopped (stop of rotation of drum 3, etc.) (step 18). Then, as the time $t_3$ expires with no data entry through the board 48, the copier is brought into the standby condition (low temperature heat generation by heater, etc.) (steps 19 to 21). In the standby mode, the program does not advance to the step 14 unless the switch 76 is operated (steps 21 to 23). Assume that the switch 76 is operated before or in the standby mode to transfer the program to the step 14 and, then, a change of color (from black to red, green or blue, or from red, green or blue to another color (except for black)) is commanded. Then, referencing the time T the count of which started upon completion of copying, the program starts on cleaning (steps 54 and 55) on condition that the count exceeds $T_1$ (steps 50 and 53). Therefore, starting to count the time T (step 101) after the end of copying is effective to shorten the waiting time, compared to a case wherein the draining time is set up anew in the event of the subsequent change of color.

(13) During cleaning (steps 12 and 55), the board reading (steps 14 and 103) is not executed while, during the drain waiting (steps 50, 53 and 58), the board reading (step 103) is executed. This is partly because the cleaning time $t_2$ is comparatively short and partly because any desired color may be set after the cleaning procedure; that is, once the cleaning procedure is initiated, it is rational for that procedure to be completed. Further, the draining time $T_8$ is comparatively long and the operator may desire to change the recording color before it expires; even if the board reading (step 103) is executed and, then, processing is performed in response to an input on the operating board 48, all that is required to maintain the continuity in waiting for the drainage is continuously counting the time T.

(14) After the cleaning process (steps 12 and 55), the cleaning-done flag is set to show that the developing device 5 is clean. Subsequently, when the developer supply pump 37, **37*r*, 37*g* or 37*b* is energized, the cleaning-done flag is cleared (step 65a). When the cleaning-done flag is present in the event of a change of recording color (except for a change from red, green or blue to black), the supply of the new developer is initiated without waiting for the drain of the previous developer and the cleaning, i.e., waiting for the drain of the cleaner only. This is effective to shorten the waiting time. Especially, when the color command is changed during the board reading (step 103) of the cleaner drainage waiting subroutine (step 58), the interval till the start of copying is effectively shortened in the development setting (steps 48 to 65*a***) which is associated with the new color.

(15) In the black record mode, the nozzle 44 is so positioned as to feed liquid to the cleaner vessel **30*i*. In this record mode, the developer in the developing unit 5 is returned to the first vessel 30 and, if it flows into the overflow port of the vessel 30, the solvent (diluent) from which the toner has been separated is routed toward the vessel 30*i* by the purifying device CA. When the liquid level in the vessel 30*i* is at the upper limit (switch 34*i* closed), the nozzle 44 is communicated to the blue developer vessel 30*b*; when the liquid level in the vessel 30*b* is at the upper limit (switch 34*b* closed), the nozzle 44 is communicated to the green developer vessel 30*g*; when the liquid level in the vessel 30*g* is at the upper limit (switch 34*g* closed), the nozzle 44 is communicated to the red developer vessel 30*r*. When the liquid level is at the upper limit in all of the vessels 30*i*, 30*b*, 30*g* and 30*r*, the copying operation is interrupted with the alarm lamp turned on. It is to be noted that while the recording color selected is blue, green or red, the changeover of the nozzle 44 is not effected because the nozzle 44 has been positioned to return any of the developers in from the unit 5** to its associated vessel.

(16) When the upper limit switch 34 of the black developer vessel 30 is closed, indicating that the developer in the vessel 30 has flown into the purifying device CA and, moreover, the liquid level in the vessel 30 has risen slightly beyond the overflow port, the copying operation is interrupted with the alarm lamp turned on. The turnon of this lamp is indicative of the excess liquid level in the vessel 30 as well as the clogging of the filter tube FL.

Another embodiment of the present invention will be described hereinafter.

In the embodiment described above, the solvent (diluent) separated from the liquid which overflows the first or black vessel is sequentially distributed to the second to fourth vessels. In another embodiment of the present invention, as indicated by dash-and-dots lines in FIG. 1, the liquids which flow into overflow ports of the cleaner vessel 30*i*, blue developer vessel 30*b*, green developer vessel 30*g* and red developer vessel 30*r* are routed to a waste tank AT. Each of the overflow ports is provided at a slightly higher level than a level where any of the switches 34*i*, 34*b*, 34*g* and 34*r* associated therewith senses the upper limit (becomes closed). Therefore, in any of the vessels 30*i*, 30*b*, 30*g* and 30*r*, the liquid starts flowing toward the waste tank AT after the associated switch 34*i*, 34*b*, 34*g* or 34*r* has sensed the upper limit. The tank AT is provided with a float and an upper limit switch AL which are responsive to a substantially full condition of the tank AT, a microprocessor (corresponding to CPU 58) reading the state of the switch ALS. The other part of hardware is essentially similar to that of the previous embodiment.

Figure 4G:
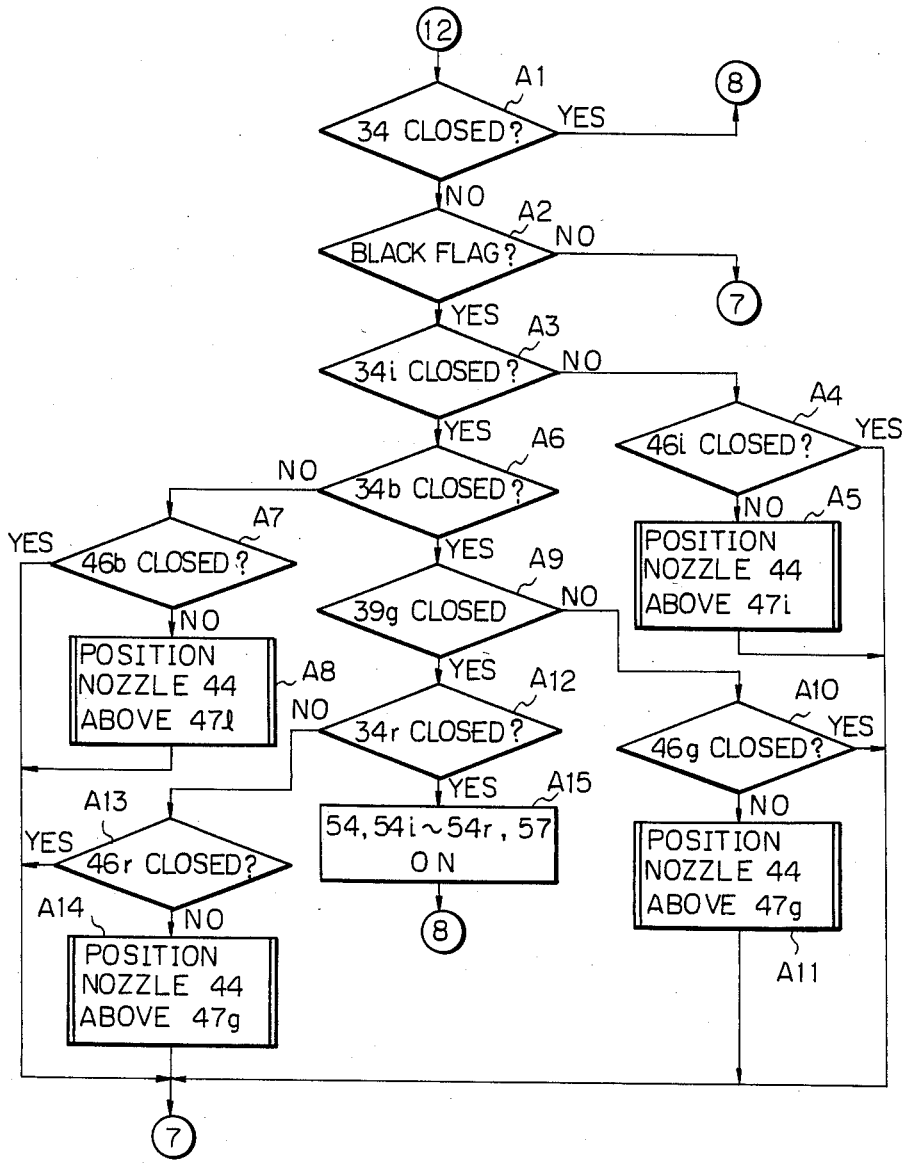
Figure 4H:
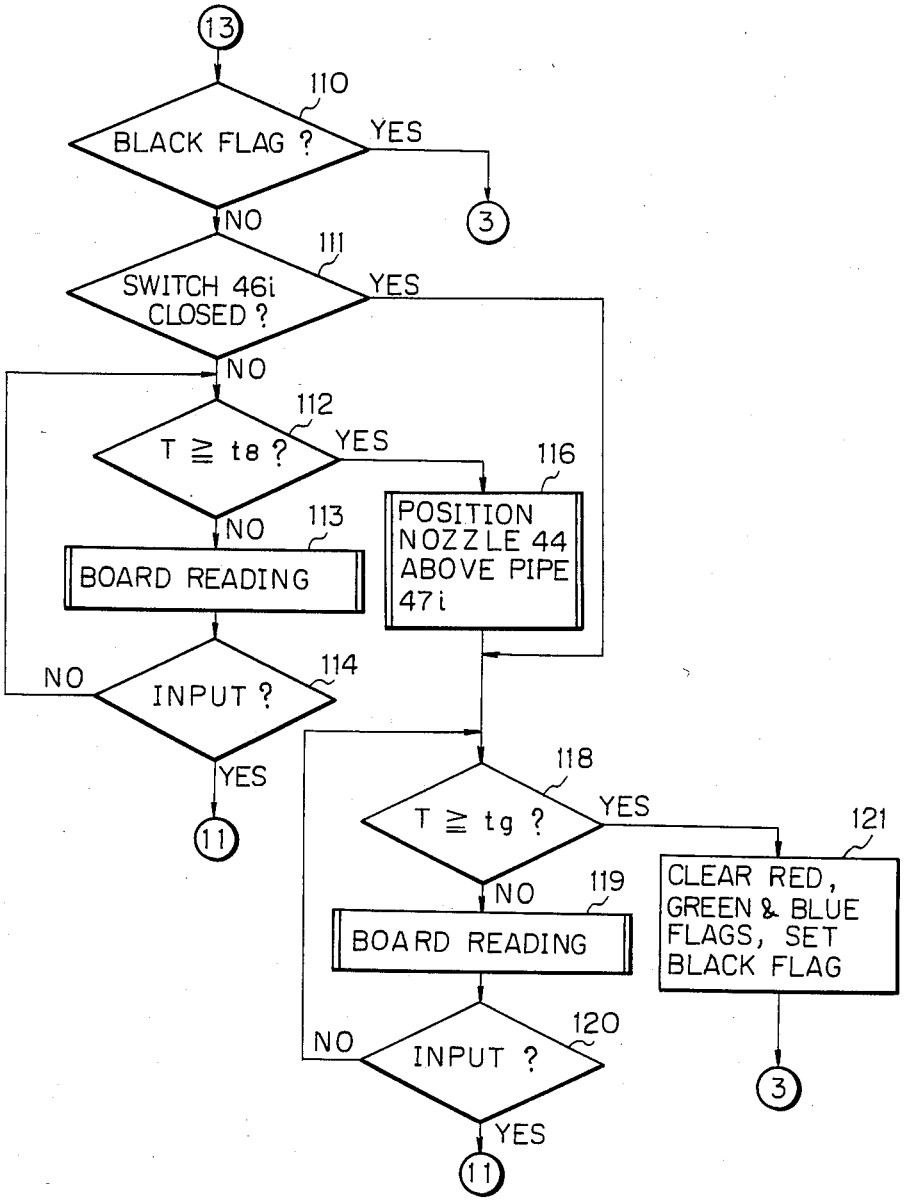
Figure 5:
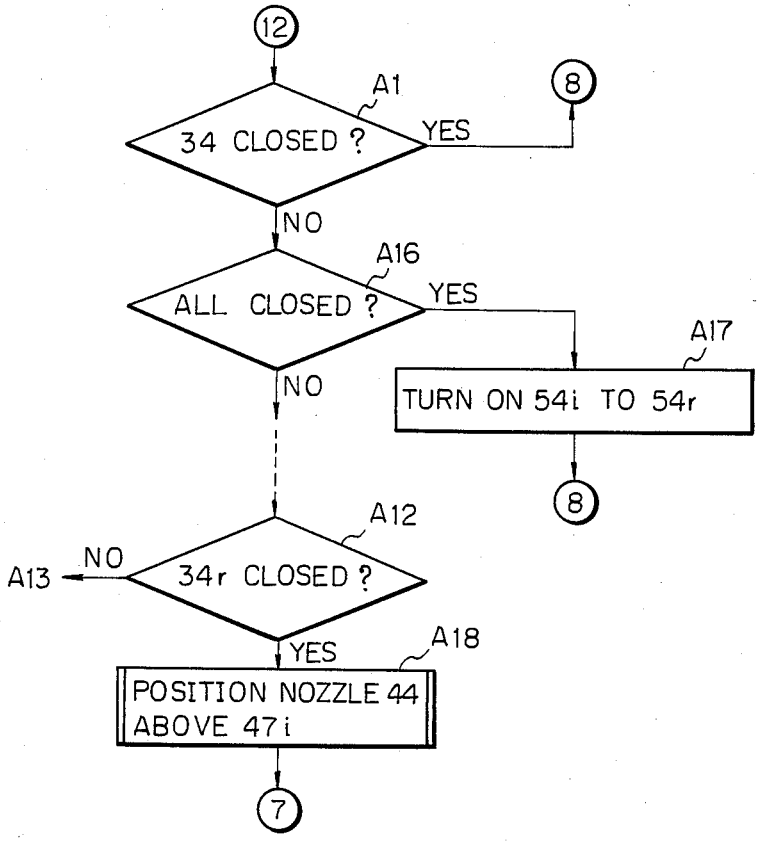
FIG. 5 is a flowchart representative of another control operation as performed by the microprocessor.

The control routines assigned to the microprocessor (58) of the second embodiment is essentially similar to those of the first embodiment except that the distribution control over the liquid as collected by the purifying device, FIG. 4*g*, is modified as shown in FIG. 5. Specifically, a step A16 of checking the state of the upper limit switch AL is provided between the steps A1 and A2 of FIG. 4*g*. When the switch ALS is closed (tank AT full), the lamps 54*i* to 54*r* are turned on to alert the operator to it and to stop the copying operation, at a step A17. Then, the program advances to the steps 39 and 82 of FIG. 4b to inhibit copying. Further, if the switch 34*r* is also found closed at the step A12 (liquid level in all of the vessels 30*i*, 30*b*, 30*g* and 30*r* reached the upper limit), the nozzle 44 is switched to the vessel 30*i* side in order to prevent the developer density in each of the vessels 30*b*, 30*g* and 30*r* from being lowered excessively. Namely, the program advances to the routine of FIG. 4*e* and not to the failure processing.

In the above construction, even if the liquid level in each of the vessels 30*i*, 30*b*, 30*g* and 30*r* has reached the upper limit in the black record mode, the liquid collected by the purifying device CA is led to the vessel 30*i* to continue with copying (black recording) so long as the switch ALS of the tank AT is open (not full). Meanwhile, in any of the blue, green and red record modes, even if the toner consumption is so great due to the reproduction of solid images that the developer supply is repeated to eventually increase the amount of developer, the excessive part of the developer is routed to the waste tank AT via the overflow port. Hence, the developer supply may be continued even if the upper limit switch is closed (upper limit), that is, the steps 68 and 76 to 80 of FIG. 4*d* may be omitted. In this condition, copies are produced continuously with their density substantially not lowered until the switch AL of the tank AT becomes closed.

Figure 6:
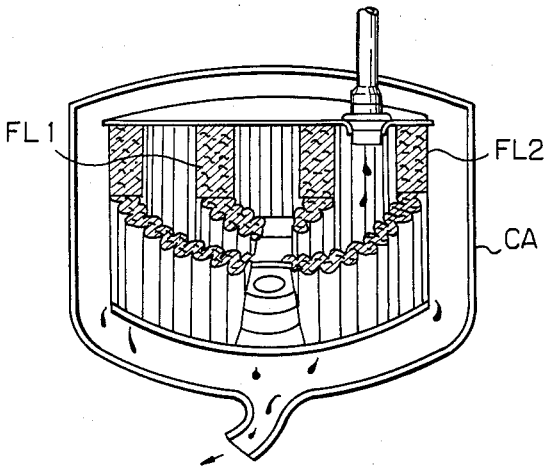
FIGS. 6 and 7 are respectively a sectional view and a perspective view each showing a modification to the purifying device of FIG. 1.
Figure 7:
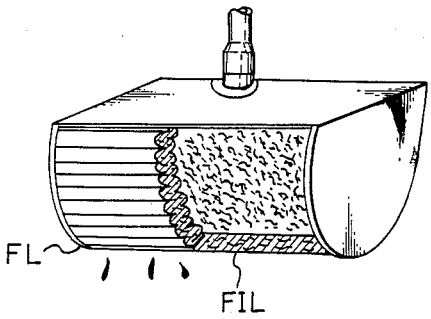

The greater the capacity of the filter tube FL of the device CA, the lower the probability of interruption of copying becomes. A simple implementation for a greater filtering capacity may be increasing the dimensions of the filter tube FL. If it is desired to attain such a filtering capacity without increasing the volume of the filter tube FL, as shown in FIG. 6, the filter tube FL may be constituted by two concentric filters FL1 and FL2 which are spaced from each other; the space between the filters FL1 and FL2 being communicated to the internal space of a housing (CA). In the alternative filter tube FL of FIG. 6, the total filtering area is increased by the FL1 so that the filtering capacity is increased without resorting to the increase in the dimensions of the device CA. To further increase the filtering capacity, the space between the filters FL1 and FL2 may be filled with natural fibers, synthetic fibers or filaments of any other material, activated charcoal, ion exchange resin, etc. When such a filler is positively used, the filter tube FL may be provided with a semicircular cross-section and filled with a filler FIL, as shown in FIG. 7.

In any of the foregoing embodiments, the liquid in the developing unit 5 is returned to the first or black developer vessel 30 through the valve 39, and returned to each of the other vessels through the valve 39, common path IMP and nozzle 44; the solvent (diluent) separated by the purifying device FL from the excessive part of developer which flows out of the vessel 30 is distributed to the other vessels. Therefore, even if the liquid level in the first developer is raised due to the return of the toner from the cleaning unit 9 to the vessel 30 and the supply of a great amount of developer from the container 31 to the vessel 30, which may occur in the event of recording solid images and the like in black, recording in black or any other color can be continued until the filter tube FL becomes clogged. It follows that even when many solid images are recorded in black or when many images are recorded in other colors, it rarely occurs that the first vessel is filled up and the copying operation is stopped, enhancing the operating efficiency of the copier. The waste tank AT used in another particular embodiment allows only solid black recording or recording in any other color to be continued over a long period of time, further enhancing the operating efficiency of the copier; especially, even if solid images are repeatedly recorded in any color other than black, the vessel adapted to store the developer of that color is substantially prevented from overflowing. This eliminates the need for the interruption of copying due to overflow and, so long as the tank AT is not full, allows the copying cycle to be repeated.

In the embodiment described above, the black developer is stored in the first vessel, i.e., the first color is black. However, in the arrangement wherein the previously used developer is collected in the first vessel in the event when the record mode is changed over from the color record mode other than the black mode to the black mode, as in the embodiment shown and described, it is not always necessary for pure black developer to be returned to the first vessel because the mixture of developers other than the black one collected in the first vessel is in effect a black developer. Hence, the first vessel adapted to store the first color should not necessarily be supplied with pure black developer.

In the above embodiment, an arrangement is made such that upon the change of recording color command from red, green or blue to black the pump 37*r*, 37*g* or 37*b* having supplied the associated developer is deactivated, the valve is immediately switched toward the first vessel 30 side (step 45), and the pump 37 is activated (step 46). This is because the amount of developer in the developing unit 5 is so small that, even if the previous developer is collected in the vessel 30, the increase in the amount of liquid in the vessel 30 and, therefore, the change in the color of developer is negligible. In an embodiment wherein such is not negligible, a wait $T_1$ control step which is similar to the step 50 is inserted between the steps 44 and 45, so that the supply of black developer may be initiated after waiting the drainage of the previous developer. This serves to reduce the amount of developer which is to be collected in the vessel 30, while suppressing the mixture of another developer with the black developer.

Because the embodiment shown and described does not use an extra power source for backing up the memory while the power switch is OFF, it is constructed such that upon turnon of the power the lapse of draining time $T_1$ is waited for, then the developing unit 5 is cleaned, and then the unit 5 is initialized. In a particular embodiment which uses an extra power source for backing up the counter adapted to count the time T, the CPU, or the CPU and the RAM, the steps **7*b* to 13 may be omitted to shorten the interval between the power O and the copy start. Even in such an alternative procedure, there is included an automatic cleaning control for automatically cleaning the unit 5 upon the lapse of a predetermined period of time since the turnoff of the power, thereby preventing any developer from being solidified on the rollers and others inside of the unit 5. In the above-stated embodiment which uses a back-up power source to preserve necessary data when the power switch is OFF, three or all of the switches 46 which are responsive to the positions of the nozzle 4 may be omitted. Where three of them are omitted, the switch 46*i*, for example, is used as a home position switch. Where all of them are omitted, on the other hand, the nozzle 44 will be positioned above a particular one (e.g. 47*i*) of the pipes 74 in the event of assemblage, nozzle position data will be loaded in a memory which is backed up by the extra power source, and the nozzle position data will thereafter be updated for each step of the forward and reverse rotations of the stepping motor 45. A similar control is usable to trace the position of the valve 39, in which case the switch 43**, too, is omissible.

In the above description, the copier is assumed to be a monocolor copier. In a farther embodiment of the present invention, the copier comprises a full-color copier having a paper transport mechanism for selectively guiding papers from the outlet of the fixing unit 24 to the inlet of the register rollers 22, and a filter unit consisting of a plurality of filter elements and interposed between the drum 3 and the mirror 15. Specifically, when full-color reproduction is commanded, a single paper is returned from the fixing unit 24 to the register rollers 22 and the filter elements of the filter unit are switched from one to another, whereby images are sequentially reproduced one upon another on the paper in different colors such as cyan, magenta and yellow.

In summary, it will be seen that a color recording apparatus in accordance with the present invention is constructed to communicate a developer collection system to a cleaner vessel when a predetermined period of time expires with no recording action taken after color recording. This effectively shortens a period of time necessary for the next change of recording color and recording operation and, in addition, allows a minimum of damage to result from a trouble in the collection system because the collection system is communicated to the cleaner vessel side.

Various modifications will become possible for those skilled in the art after receiving the teachings of the present disclosure without departing from the scope thereof.

What is claimed is:

1. A recording apparatus having a visualizing device which selectively supplies visualizing agents to a photoconductive element, comprising:

a first vessel storing a black visualizing agent;

a second vessel storing a visualizing agent of another color;

a cleaner vessel storing a cleaning agent for cleaning said visualizing agents;

first supply means for supplying said visualizing agent in said first vessel to said visualizing device;

second supply means for supplying said visualizing agent in said second vessel to said visualizing device;

cleaner supply means for supplying said cleaning agent in said cleaner vessel to said visualizing device;

switching means for causing said agents to be selectively collected from said visualizing device into either said first vessel, said second vessel or said cleaner vessel;

color commanding means for commanding a recording color;

monitoring means for monitoring a color condition of supply of any of said agents to said visualizing device and providing an output signal indicative of said color condition;

comparing means for comparing said output signal to a reference value for a recording color commanded by said color commanding means and when the comparison indicates an unsatisfactory color condition, initiating cleaning of said visualizing device by commanding said cleaner supply means supply of said cleaning agent and commanding said switching means collection in said cleaner vessel and, after the cleaning, actuating said supply means and switching means in correspondence to said commanded color to said visualizing device, thereby performing recording in said commanded color; and control means for conditioning said switching means for collection in said cleaner vessel when a predetermined period of time expires before said recording means begins a subsequent recording operation after a recording operation in another color.

2. A recording apparatus as claimed in claim 1, wherein when said predetermined period of time expires before said recording means begins a recording operation after a recording operation in another color, said control means conditions said switching means for the collection in said cleaner vessel and selects black as a color which is commanded by said color commanding means.

3. A recording apparatus as claimed in claim 1, wherein said recording apparatus comprises an electrophotographic recording apparatus having a photoconductive element, means for providing an electrostatic latent image on said photoconductive element which corresponds to image light, a developing device for developing said latent image to produce a visible image, means for transferring said visible into onto a paper, and means for cleaning a surface of said photoconductive element after transfer of of said visible image, said visualizing device comprising said developing device.

* * * * *